US009182725B2

(12) United States Patent
Hayakawa

(10) Patent No.: US 9,182,725 B2
(45) Date of Patent: Nov. 10, 2015

(54) DRIVE SWITCHING DEVICE AND IMAGE FORMING APPARATUS

(71) Applicant: FUJI XEROX CO., LTD., Tokyo (JP)

(72) Inventor: Yuji Hayakawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/315,919

(22) Filed: Jun. 26, 2014

(65) Prior Publication Data

US 2015/0098728 A1 Apr. 9, 2015

(30) Foreign Application Priority Data

Oct. 8, 2013 (JP) ..... 2013-210782

(51) Int. Cl.
*G03G 15/00* (2006.01)
*G03G 15/16* (2006.01)

(52) U.S. Cl.
CPC ..... *G03G 15/757* (2013.01); *G03G 15/1615* (2013.01); *G03G 2215/0132* (2013.01)

(58) Field of Classification Search
CPC ..... G03G 15/0189; G03G 15/757; G03G 21/1647
USPC ..... 399/167, 228, 299, 302
See application file for complete search history.

(56) References Cited

U.S. PATENT DOCUMENTS

| | | | | |
|---|---|---|---|---|
| 6,795,671 | B2 * | 9/2004 | Matsuoka | 399/228 |
| 6,801,736 | B2 * | 10/2004 | Senda | 399/167 |
| 7,995,951 | B2 * | 8/2011 | Nieda | 399/167 |
| 2009/0245869 | A1 | 10/2009 | Nieda | |

FOREIGN PATENT DOCUMENTS

JP B2-5146045 2/2013

* cited by examiner

*Primary Examiner* — William J Royer
(74) *Attorney, Agent, or Firm* — Oliff PLC

(57) ABSTRACT

A drive switching device includes a driving source and a switching unit. The driving source is rotationally driven in one direction. The switching unit is linked with the driving source such that a driving force therefrom is intermittently transmittable to the switching unit, and switches a transmission direction of the driving force from the driving source between a first direction and a second direction every time the switching unit is linked with the driving source.

6 Claims, 18 Drawing Sheets

DRIVE SWITCHING DEVICE AND IMAGE FORMING APPARATUS

CROSS-REFERENCE TO RELATED APPLICATIONS

This application is based on and claims priority under 35 USC 119 from Japanese Patent Application No. 2013-210782 filed Oct. 8, 2013.

BACKGROUND

1. Technical Field

The present invention relates to drive switching devices and image forming apparatuses.

2. Summary

According to an aspect of the invention, there is provided a drive switching device including a driving source and a switching unit. The driving source is rotationally driven in one direction. The switching unit is linked with the driving source such that a driving force therefrom is intermittently transmittable to the switching unit, and switches a transmission direction of the driving force from the driving source between a first direction and a second direction every time the switching unit is linked with the driving source.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

First Exemplary Embodiment

Figure 1:
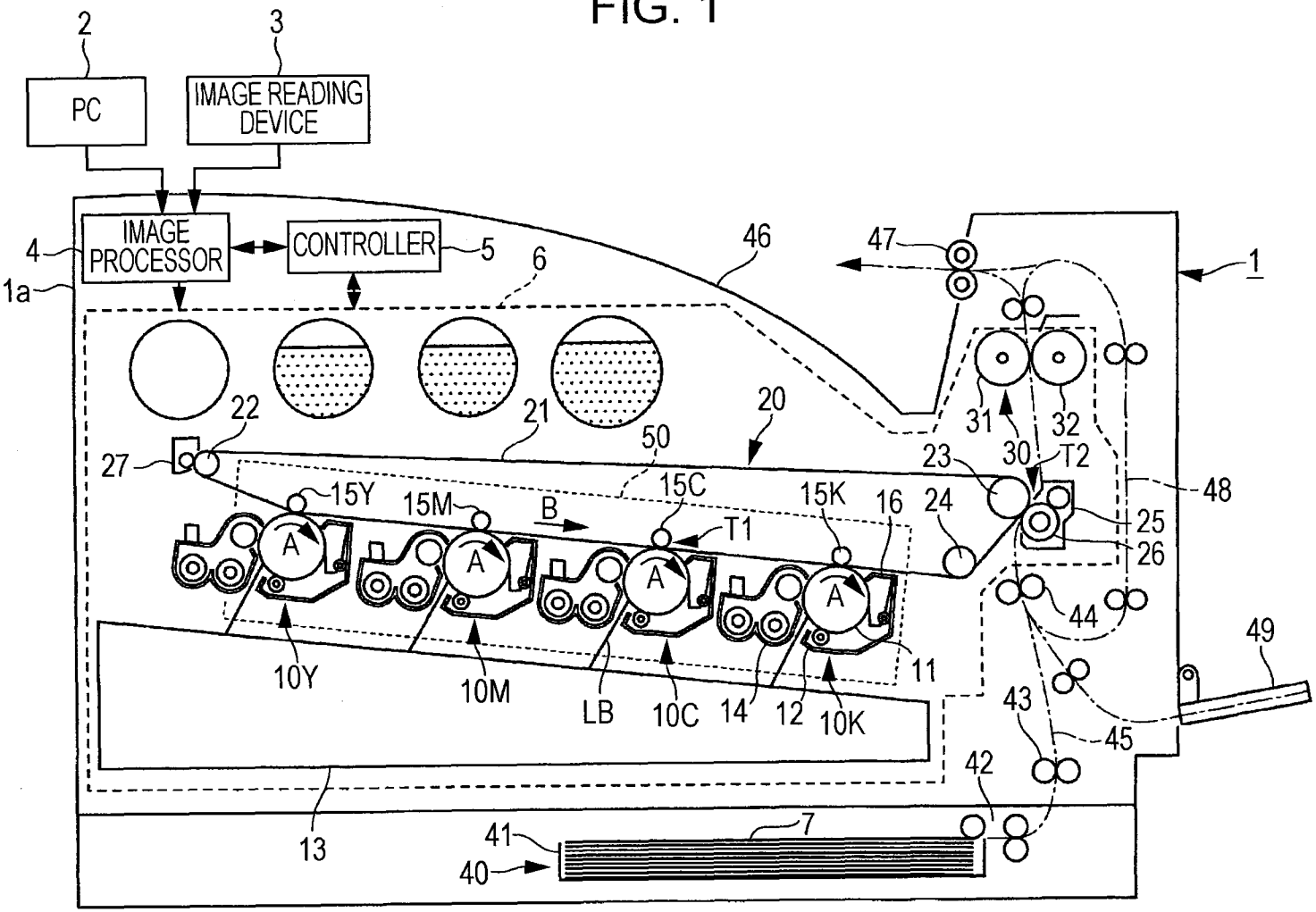
FIG. 1 schematically illustrates the configuration of an image forming apparatus according to a first exemplary embodiment of the present invention.

FIG. 1 schematically illustrates the overall configuration of an image forming apparatus according to a first exemplary embodiment.

Overall Configuration of Image Forming Apparatus

An image forming apparatus 1 according to the first exemplary embodiment is a color printer. The image forming apparatus 1 receives image data from, for example, a personal computer (PC) 2 or an image reading device 3.

As shown in FIG. 1, the image forming apparatus 1 has a housing 1*a* in which an image processor 4 and a controller 5 are disposed. Where appropriate, the image processor 4 performs predetermined image processing on the image data transmitted from, for example, the PC 2 or the image reading device 3. Examples of the predetermined image processing include shading correction, misregistration correction, brightness/color-space conversion, gamma correction, frame deletion, and color/movement edition. The controller 5 controls the overall operation of the entire image forming apparatus 1.

The image data having undergone the predetermined image processing at the image processor 4 is converted into image data for four colors, namely, yellow (Y), magenta (M), cyan (C), and black (K) colors, by the image processor 4, and is output as a full-color image or a monochrome image by an image output unit 6 provided within the image forming apparatus 1. This will be described below.

The image output unit 6 includes multiple image forming devices 10 that form toner images to be developed with toners that constitute developers, an intermediate transfer device 20 that bears the toner images formed by the image forming devices 10 and transports the toner images to a second-transfer position T2 where the toner images are ultimately second-transferred onto recording paper 7 as an example of a recording medium, and a fixing device 30 that fixes the toner images second-transferred on the recording paper 7 by the intermediate transfer device 20 onto the recording paper 7. Furthermore, a paper feed device 40 that accommodates therein and transports a desired number of recording paper 7 to be supplied to the second-transfer position T2 of the intermediate transfer device 20 is provided in combination with the image output unit 6. The housing 1*a* is formed of, for example, a support structure member or an outer cover.

The image forming devices 10 include four image forming devices 10Y, 10M, 10C, and 10K that dedicatedly form yellow (Y), magenta (M), cyan (C), and black (K) toner images, respectively. The four image forming devices 10 (Y, M, C, and K) are arranged in a single line within the housing 1*a*.

As shown in FIG. 1, the image forming devices 10 (Y, M, C, and K) each include a photoconductor drum 11 as anexample of a rotatable image bearing member. The photoconductor drum 11 is surrounded by the following devices. Such devices include a charging device 12 that electrostatically charges an image-formable peripheral surface (i.e., image bearing surface) of the photoconductor drum 11 to a predetermined potential; an exposure device 13 as an exposure unit that radiates a light beam LB based on image information (signal) onto the electrostatically-charged peripheral surface of the photoconductor drum 11 so as to form an electrostatic latent image (of the corresponding color) with a potential difference; a developing device 14 (Y, M, C, or K) as a developing unit that develops the electrostatic latent image into a toner image by using the toner of the developer of the corresponding color (Y, M, C, or K); a first-transfer device 15 (Y, M, C, or K)that transfers the toner image onto the intermediate transfer device 20 at a first-transfer position T1; and a drum cleaning device 16 that performs cleaning by removing extraneous matter, such as residual toner, from the image bearing surface of the photoconductor drum 11 after the first-transfer process.

Each photoconductor drum 11 is formed by forming an image bearing surface having a photoconductive layer (photosensitive layer) composed of a photosensitive material around the peripheral surface of a cylindrical or columnar base material, which is connected to ground. The photoconductor drum 11 is supported in a rotatable manner in a direction indicated by an arrow A by receiving a driving force from a driving device 50, which will be described later.

Each charging device 12 is constituted of a contact-type charging roller that is disposed in contact with the photoconductor drum 11. The charging device 12 is supplied with charge voltage. In a case where the developing device 14 is configured to perform reversal development, the supplied charge voltage is a voltage or current with the same polarity as the charge polarity of the toner supplied from the developing device 14.

The exposure device 13 radiates light beams LB in accordance with image information input to the image forming apparatus 1 onto the electrostatically-charged peripheral surfaces of the photoconductor drums 11 so as to form electrostatic latent images thereon. When a latent-image forming process is to be performed, image information (signal) input to the image forming apparatus 1 via an arbitrary unit and processed by the image processor 4 is transmitted to the exposure device 13.

Figure 2:
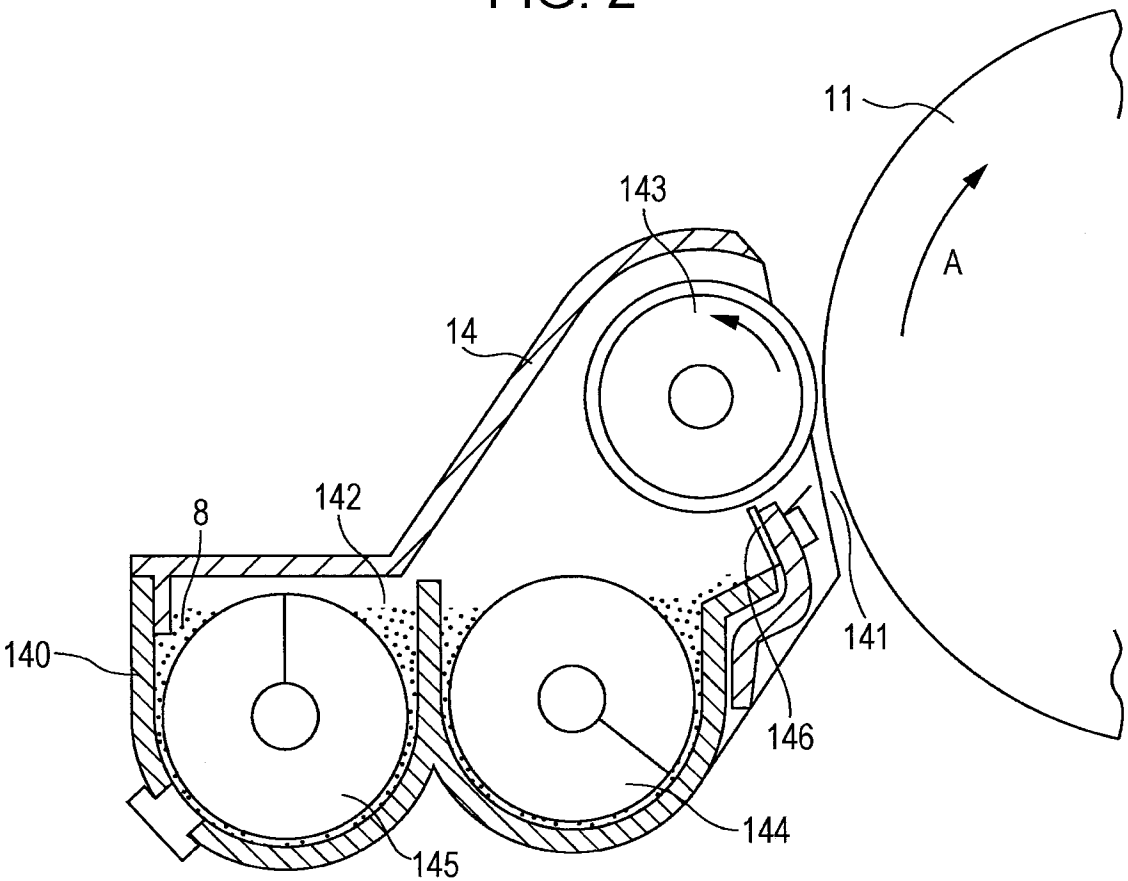
FIG. 2 illustrates the configuration of a developing device of the image forming apparatus according to the first exemplary embodiment of the present invention.

As shown in FIG. 2, each developing device 14 has a housing 140 having an opening 141 and an accommodation chamber 142 for a developer 8. The housing 140 accommodates therein, for example, a developing roller 143 that holds the developer 8 and transports the developer 8 to a developing region that faces the photoconductor drum 11, two stirrer transport members 144 and 145, such as screw augers, which transport and supply the developer 8 to the developing roller 143 while stirring the developer 8, and a layer-thickness regulating member 146 that regulates the amount (layer thickness) of the developer 8 held by the developing roller 143. The developing device 14 is supplied with development bias voltage between the developing roller 143 and the photoconductor drum 11 from a power supply device (not shown). Furthermore, the developing roller 143 and the stirrer transport members 144 and 145 receive a driving force from the driving device 50, which will be described later, so as to rotate in a predetermined direction. Each of the four-color developers 8 used above is a two-component developer containing a non-magnetic toner and a magnetic carrier.

Each first-transfer device 15 (Y, M, C, or K) is a contact-type transfer device including a first-transfer roller that rotates by coming into contact with the peripheral surface of the photoconductor drum 11 via an intermediate transfer belt 21 and that is supplied with first-transfer voltage. The first-transfer voltage is a direct-current voltage with a reversed polarity relative to the charge polarity of the toner and is supplied from a power supply device (not shown).

Each drum cleaning device 16 is constituted of, for example, a container body having an opening in a part thereof, a cleaning plate that cleans the peripheral surface of the photoconductor drum 11 after the first-transfer process by coming into contact therewith with predetermined pressure so as to remove extraneous matter, such as residual toner, therefrom, and a collecting device that collects the extraneous matter removed by the cleaning plate.

As shown in FIG. 1, the intermediate transfer device 20 is disposed at a position above the image forming devices 10 (Y, M, C, and K). The intermediate transfer device 20 includes the intermediate transfer belt 21 that rotates in a direction indicated by an arrow B while passing through the first-transfer positions T1 between the photoconductor drums 11 and the first-transfer devices 15 (Y, M, C, or K) (first-transfer rollers); multiple belt support rollers 22 to 24 that rotatably support the intermediate transfer belt 21 from the inner surface thereof so as to maintain the intermediate transfer belt 21 in a desired state; a second-transfer device 25 that is disposed adjacent to the outer peripheral surface (image bearing surface) of the intermediate transfer belt 21 supported by the belt support roller 23 and that second-transfers the toner images on the intermediate transfer belt 21 onto the recording paper 7; and a belt cleaning device 27 that performs cleaning by removing extraneous matter, such as residual toner and paper particles, from the outer peripheral surface of the intermediate transfer belt 21 after passing through the second-transfer device 25.

The intermediate transfer belt 21 is an endless belt composed of, for example, a material obtained by dispersing a resistance adjustor, such as carbon black, in synthetic resin, such as polyimide resin or polyamide resin. The belt support roller 22 serves as a driven roller, the belt support roller 23 serves as a driving roller as well as a second-transfer backup roller, and the belt support roller 24 serves as a tension-applying roller.

As shown in FIG. 1, the second-transfer device 25 is a contact-type transfer device including a second-transfer roller 26 that is supplied with second-transfer voltage and that rotates by coming into contact with the peripheral surface of the intermediate transfer belt 21 at the second-transfer position T2, which is an outer peripheral area of the intermediate transfer belt 21 supported by the belt support roller 23 in the intermediate transfer device 20. The second-transfer voltage supplied to the second-transfer roller 26 or the belt support roller 23 of the intermediate transfer device 20 is a direct-current voltage with a reversed polarity relative to or the same polarity as the charge polarity of the toners.

The fixing device 30 includes, for example, a roller-type or belt-type heating rotatable member 31 whose surface temperature is heated to and maintained at a predetermined temperature by a heating unit, and a roller-type or belt-type pressing rotatable member 32 that rotates by being in contact with the heating rotatable member 31 with predetermined pressure. In the fixing device 30, a contact area where the heating rotatable member 31 and the pressing rotatable member 32 are in contact with each other serves as a fixing-process section where a predetermined fixing process (i.e., heating and pressing) is performed.

The paper feed device 40 is disposed at a position below the exposure device 13. The paper feed device 40 includes a single paper accommodation body (or multiple paper accommodation bodies) 41 that accommodates recording paper 7 of a desired size and type in a stacked fashion, and a feed device 42 that feeds the recording paper 7 in a sheet-by-sheet fashion from the paper accommodation body 41. The paper accommodation body 41 is attached in an ejectable manner toward the front surface (i.e., a side surface facing a user during user's operation) of the housing 1*a*.

Multiple pairs of paper transport rollers 43 and 44, which transport the recording paper 7 fed from the paper feed device 40 toward the second-transfer position T2, and a feed transport path 45 constituted of transport guide members are provided between the paper feed device 40 and the second-transfer device 25. The pair of paper transport rollers 44 disposed immediately before the second-transfer position T2 in the feed transport path 45 serves as, for example, rollers (registration rollers) that adjust the transport timing of the recording paper 7. Furthermore, a pair of discharge rollers 47 that discharge the recording paper 7 toward an output accommodation section 46 is disposed downstream of the fixing device 30 in the paper transport direction.

In FIG. 1, reference character 48 denotes a duplex transport path, and reference character 49 denotes a manual feed device.

The image forming apparatus 1 according to this exemplary embodiment has a full-color mode (first mode) and a monochrome mode (second mode) that are switch-controlled by the controller 5. In the full-color mode, an image is formed by using the yellow (Y), magenta (M), cyan (C), and black (K) image forming devices 10 (Y, M, C, and K). In the monochrome mode, an image is formed by using the black (K) image forming device 10K alone. In the full-color mode, the photoconductor drums 11 of all the image forming devices 10 (Y, M, C, and K) come into contact with the intermediate transfer belt 21. On the other hand, in the monochrome mode, only the photoconductor drum 11 of the black (K) image forming device 10K comes into contact with the intermediate transfer belt 21, whereas the photoconductor drums 11 for the remaining colors (Y, M, and C) are disposed away from the intermediate transfer belt 21.

Figure 3A:
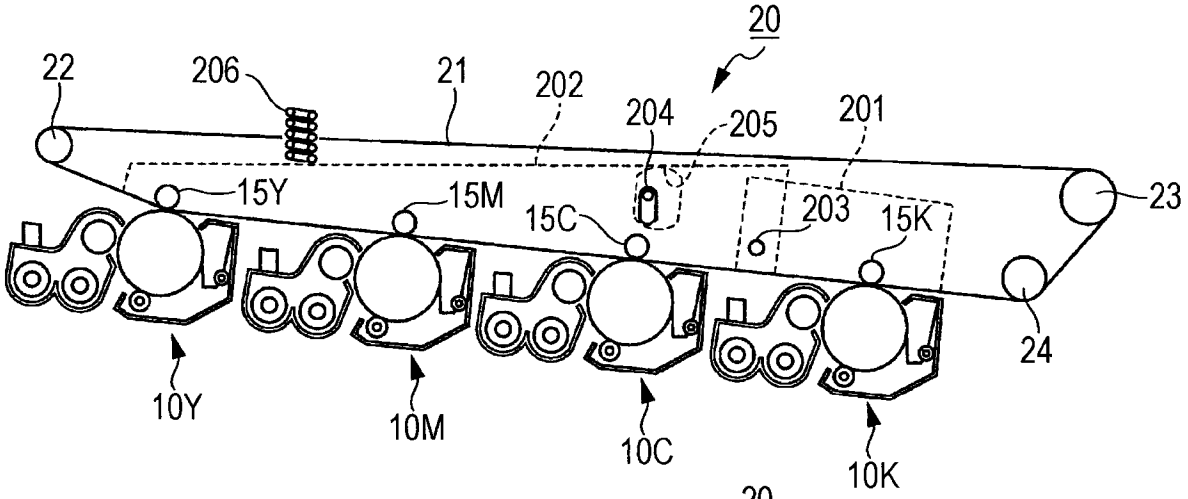
FIGS. 3A and 3B illustrate the configuration of a relevant part of the image forming apparatus according to the first exemplary embodiment of the present invention.

Therefore, as shown in FIG. 3A, the intermediate transfer device 20 includes a first support member 201 that rotatably supports the first-transfer roller 15K of the black (K) image forming device 10K and a second support member 202 that rotatably supports the first-transfer rollers 15 (Y, M, and C) of the yellow, magenta, and cyan image forming devices 10 (Y, M, and C). The second support member 202 is disposed in a rotatable (tiltable) manner about a fulcrum shaft 203 such that the intermediate transfer belt 21 is movable away from the photoconductor drums 11 (Y, M, and C) together with the first-transfer rollers 15 (Y, M, and C). The second support member 202 includes an eccentric cam 204 that is rotationally driven by the driving device 50, which will be described later, a recess 205 that allows the second support member 202 to rotate via the eccentric cam 204, and a coil spring 206 that presses the second support member 202 toward the image forming devices 10 (Y, M, and C).

Basic Operation of Image Forming Apparatus

Basic image forming operation performed by the image forming apparatus 1 will be described below.

The image forming operation described below is performed when forming a full-color image constituted of a combination of four-color (Y, M, C, and K) toner images by using the four image forming devices 10 (Y, M, C, and K).

When the image forming apparatus 1 receives image-formation(print) request command information, the four image forming devices 10 (Y, M, C, and K), the intermediate transfer device 20, the second-transfer device 25, the fixing device 30, and the like are actuated.

In each of the image forming devices 10 (Y, M, C, and K), the photoconductor drum 11 first rotates in the direction of the arrow A, and the charging device 12 electrostatically charges the surface of the photoconductor drum 11 to a predetermined polarity (negative polarity in the first exemplary embodiment) and a predetermined potential. Then, the exposure device 13 radiates light beams LB onto the electrostatically-charged surfaces of the photoconductor drums 11 so as to form electrostatic latent images of the respective color components (Y, M, C, and K) with a predetermined potential difference on the surfaces. Specifically, the light beams LB are emitted based on image signals obtained by the image processor 4 converting image information input to the image forming apparatus 1 from the PC 2, the image reading device 3, or the like into respective color components (Y, M, C, and K).

Subsequently, each of the developing devices 14 (Y, M, C, and K) performs a developing process by supplying and electrostatically adhering the toner of the corresponding color (Y, M, C, or K) electrostatically charged to a predetermined polarity (negative polarity) onto the electrostatic latent image of the corresponding color component formed on the photoconductor drum 11. As a result of this developing process, the electrostatic latent images of the respective color components formed on the photoconductor drums 11 are made into four-color (Y, M, C, and K) visible toner images that have been developed using the toners of the corresponding colors.

Subsequently, when the toner images formed on the photoconductor drums 11 of the image forming devices 10 (Y, M, C, and K) are transported to the respective first-transfer positions T1, the first-transfer devices 15 (Y, M, C, and K)sequentially first-transfer the toner images onto the intermediate transfer belt 21, rotating in the direction of the arrow B, of the intermediate transfer device 20 in a superimposing manner.

When the first-transfer process is completed in each image forming device 10, the drum cleaning device 16 cleans the surface of the photoconductor drum 11 by scraping off and removing extraneous matter, such as residual toner, from the surface of the photoconductor drum 11. Thus, the image forming devices 10 become ready for subsequent image forming operation.

Subsequently, the intermediate transfer device 20 bears and transports the first-transferred toner images to the second-transfer position T2 by rotating the intermediate transfer belt 21. On the other hand, the paper feed device 40 feeds recording paper 7 to the feed transport path 45 in accordance with the image forming operation. In the feed transport path 45, the pair of paper transport rollers 44 as registration rollers transports and feeds the recording paper 7 to the second-transfer position T2 in accordance with the transfer timing.

At the second-transfer position T2, the second-transfer roller 26 collectively second-transfers the toner images on the intermediate transfer belt 21 onto the recording paper 7. When the second-transfer process is completed in the intermediate transfer device 20, the belt cleaning device 27 cleans the surface of the intermediate transfer belt 21 by removing extraneous matter, such as residual toner, therefrom after the second-transfer process.

Subsequently, the recording paper 7 with the second-transferred toner images is detached from the intermediate transfer belt 21 and the second-transfer roller 26 and is then transported to the fixing device 30. The fixing device 30 performs a fixing process (heating and pressing) so as to fix the unfixed toner images onto the recording paper 7. Finally, the recording paper 7 having undergone the fixing process is discharged by the pair of discharge rollers 47 onto the output accommodation section 46 provided at an upper part of the housing 1*a*.

As a result of the above-described operation, the recording paper 7 having formed thereon a full-color image constituted of a combination of four-color toner images is output.

Referring to FIG. 3A, in a case where a monochrome image is to be formed in the image forming apparatus 1, the eccentric cam 204 is rotated counterclockwise by the driving device 50, which will be described later. Thus, referring to FIG. 3B, the eccentric cam 204 causes the second support member 202 to rotate clockwise about the fulcrum shaft 203 against the pressing force of the coil spring 206 via the recess 205. Therefore, the intermediate transfer belt 21 moves away from the photoconductor drums 11 of the image forming devices 10 (Y, M, and C) together with the first-transfer rollers 15 (Y, M, and C).

When the intermediate transfer belt 21 moves away from the photoconductor drums 11 of the image forming devices 10 (Y, M, and C), rotational driving of the photoconductor drums 11 and the developing devices 14 stops as described below. In a case where a full-color image is to be formed in the image forming apparatus 1, the eccentric cam 204 is rotated clockwise by the driving device 50, which will be described later, in the state shown in FIG. 3B so that the second support member 202 is moved downward by the pressing force of the coil spring 206, thereby bringing the intermediate transfer belt 21 and the first-transfer rollers 15 into contact with the photoconductor drums 11 of the image forming devices 10 (Y, M, and C), as shown in FIG. 3A.

Configuration of Characteristic Part of Image Forming Apparatus

Figure 4:
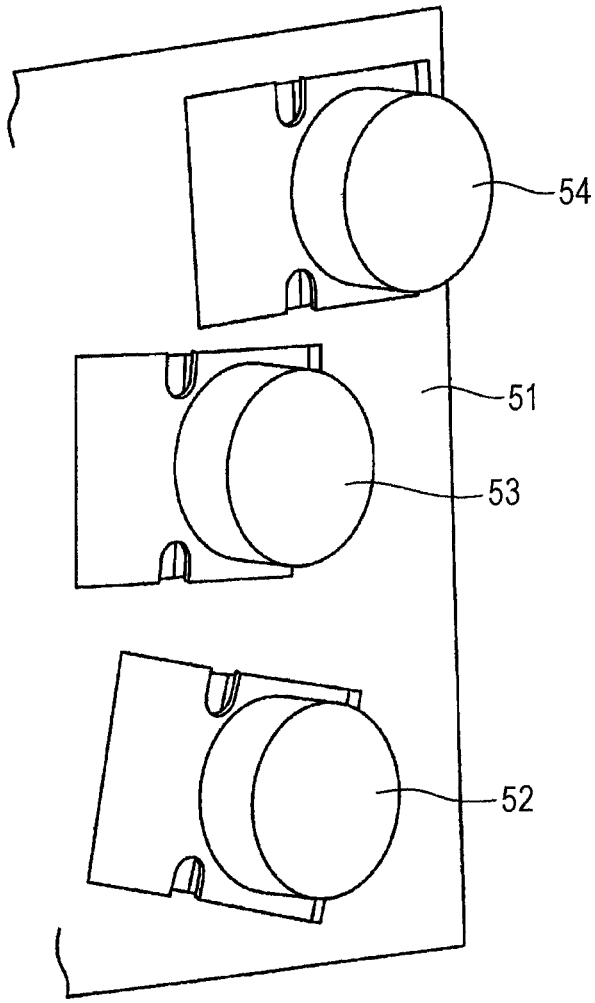
FIG. 4 is a perspective view illustrating the configuration of a driving device.

FIG. 4 is a perspective view illustrating the configuration of the driving device 50 of the image forming apparatus 1 to which a drive switching device according to this exemplary embodiment is applied.

Referring to FIG. 1, the driving device 50 of the image forming apparatus 1 according to this exemplary embodiment is disposed at the rear side of the housing 1*a*. Referring to FIG. 4, the driving device 50 includes first to third driving motors 52 to 54 as driving sources attached to the rear surface of a housing 51 of the driving device 50. The first driving motor 52 drives the four yellow, magenta, cyan, and black developing devices 14 and the paper feed device 40. The second driving motor 53 serves as a drum motor that drives the four yellow, magenta, cyan, and black photoconductor drums 11 and the intermediate transfer belt 21. The third driving motor 54 serves as a fuser motor that drives the fixing device 30, a paper output system, and a drive switching device according to this exemplary embodiment.

Figure 5:
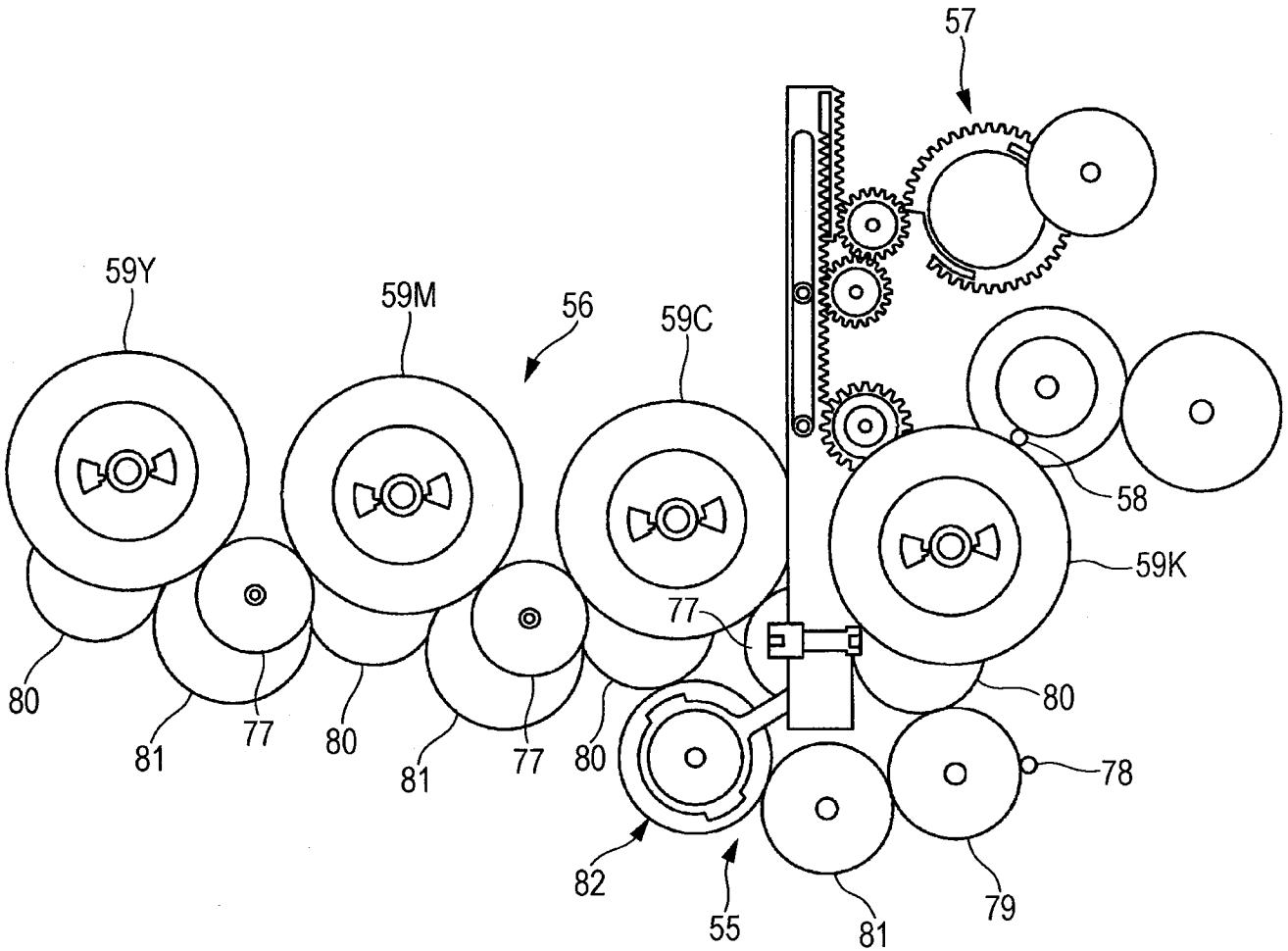
FIG. 5 illustrates the configuration of the driving device.

Referring to FIG. 5, the driving device 50 roughly includes a first driving unit 55 with the first driving motor 52 as a driving source, a second driving unit 56 with the second driving motor 53 as a driving source, and a third driving unit 57 with the third driving motor 54 as a driving source.

Figure 6A:
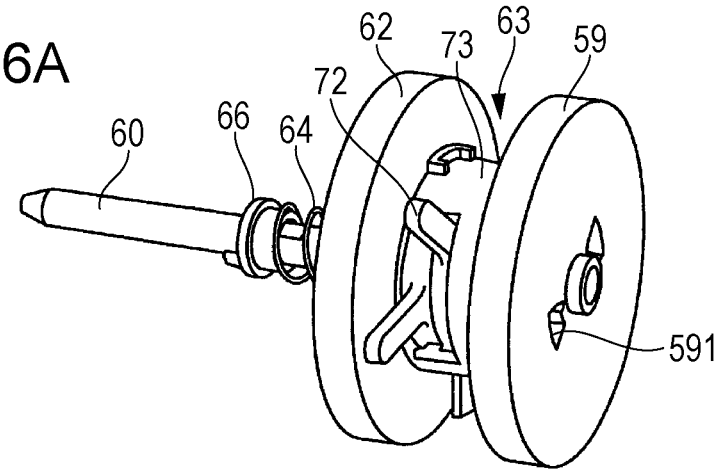
FIGS. 6A to 6C are perspective views illustrating the configuration of a driving-force transmission mechanism of a photoconductor drum.
Figure 6B:
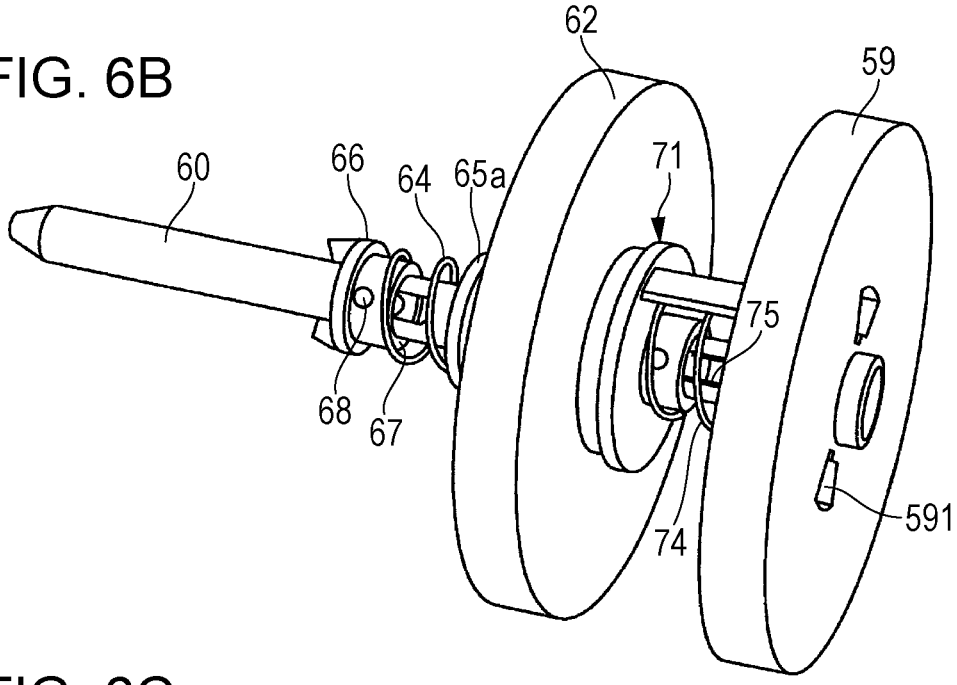
Figure 6C:
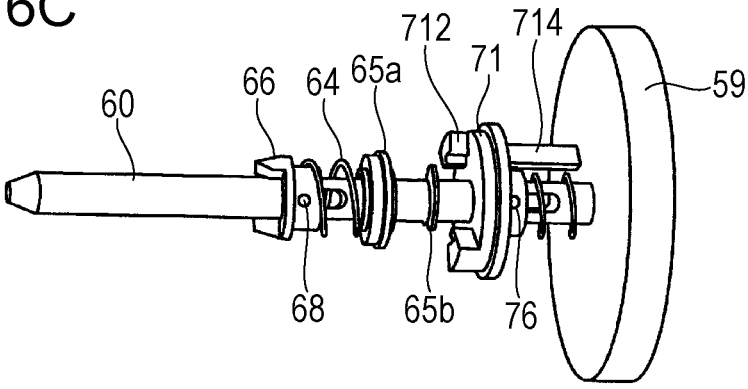

The second driving unit 56 includes a drive gear 59 (59K) that is meshed with an output gear 58 provided on an output shaft of the second driving motor 53 and that rotationally drives the black (K) photoconductor drum 11. As shown in FIGS. 6A to 6C, the drive gear 59 is fixedly attached to a drive shaft 60, which rotationally drives the black (K) photoconductor drum 11, via a pin 61 (see FIG. 8). Furthermore, a transmission gear 62 that transmits a rotational driving force to the color photoconductor drums 11 is rotatably attached to the drive shaft 60. Moreover, a photoconductor coupling mechanism 63 as a driving-force transmission mechanism that transmits or does not transmit (cuts off) the rotational driving force from the drive gear 59 to the transmission gear 62 is disposed between the drive gear 59 and the transmission gear 62.

The transmission gear 62 is sandwiched between a first ring-shaped member 65*a* and a second ring-shaped member 65*b* such that the movement thereof in the axial direction of the drive shaft 60 is restricted. Furthermore, the transmission gear 62 is rotatably disposed around the drive shaft 60. A coupling member 66 that is coupled to the photoconductor drum 11 and transmits a rotational driving force is attached to an axial end of the first ring-shaped member 65*a*. The coupling member 66 is pressed toward the photoconductor drum 11 by a coil spring 64. Furthermore, the movement range of the coupling member 66 is restricted by a pin 68 that is fitted in a first elongated hole 67 extending in the axial direction of the drive shaft 60.

Figure 7A:
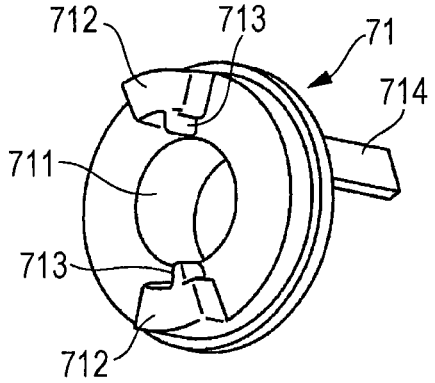
FIGS. 7A to 7C are perspective views illustrating the configuration of components that constitute the driving-force transmission mechanism.
Figure 7B:
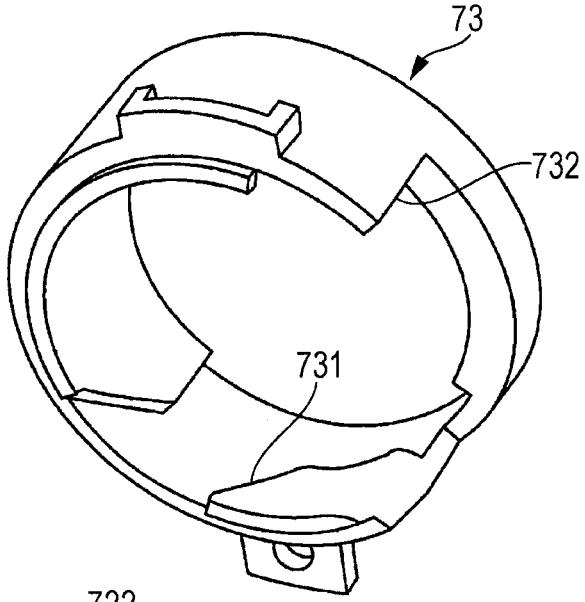
Figure 7C:
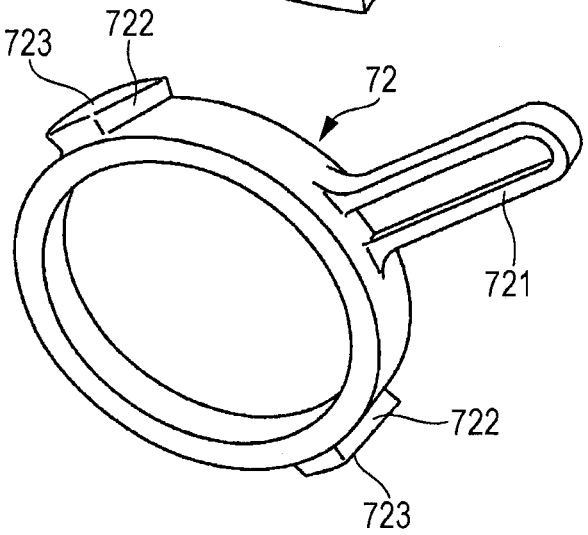

As shown in FIGS. 6A to 6C, the photoconductor coupling mechanism 63 roughly includes a coupling member 71, a link member 72, and a cover member 73. As shown in FIGS. 7A to 7C, the coupling member 71 is substantially disk-shaped and has an attachment hole 711 for attaching the coupling member 71 to the drive shaft 60 in a movable manner in the axial direction thereof. The outer periphery of an end surface of the coupling member 71 adjacent to the transmission gear 62 is provided with first projections 712 that protrude parallel to the axial direction and that are located at positions facing each other at 180°. When viewed from the axial direction, each of the first projections 712 substantially has a shape of a trapezoid surrounded by a circular-arc-shaped outer peripheral surface, a circular-arc-shaped inner peripheral surface, and opposite end surfaces extending in the radial direction. The inner peripheral surface of each first projection 712 is provided with a protrusion 713 that protrudes radially inward. The protrusion 713 is disposed at a position that is offset in one direction (rightward in FIG. 7A) from the center of the inner peripheral surface of the first projection 712. As a result, the two first projections 712 are asymmetrical with respect to the center line of the drive shaft 60. The drive gear 59 and the transmission gear 62 are phase-matched by the protrusions 713. The outer periphery of an end surface of the coupling member 71 adjacent to the drive gear 59 is provided with a second projection 714 that protrudes parallel to the axial direction and is relatively longer than the first projections 712. The second projection 714 is disposed such that the position thereof in the circumferential direction is different from those of the first projections 712. For example, the second projection 714 has the same shape as the first projections 712 and includes a protrusion 713.

Figure 8:
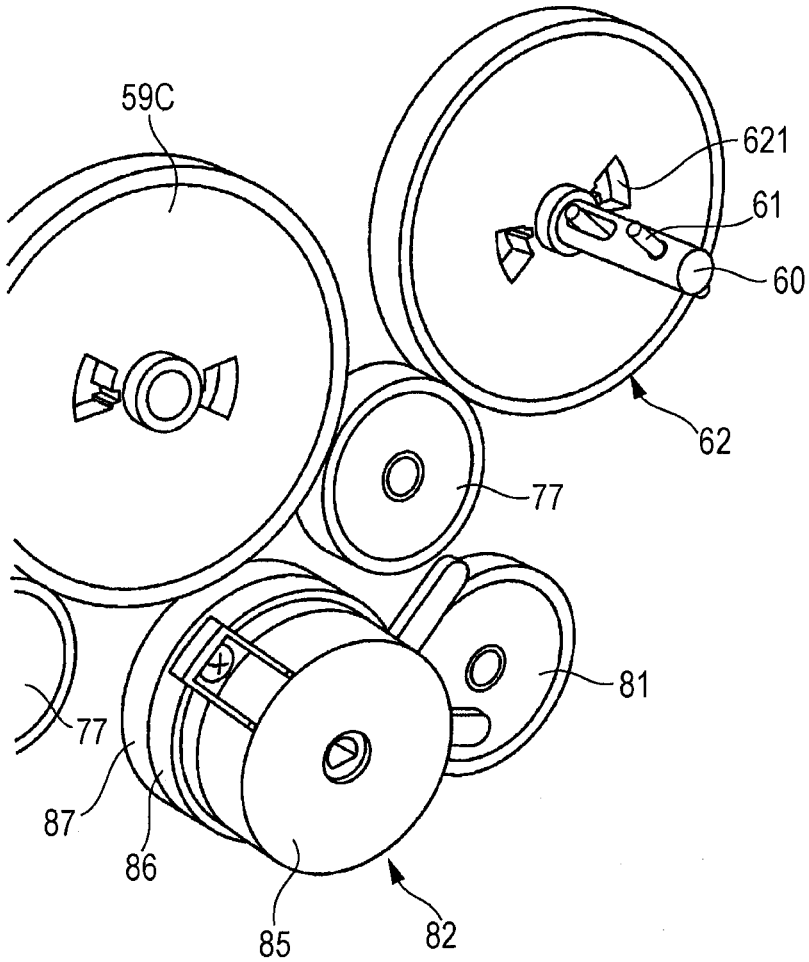
FIG. 8 is a perspective view illustrating the configuration of the driving-force transmission mechanism of the photoconductor drum.

Referring to FIG. 8, the transmission gear 62 has first recesses 621 that have a shape similar to the first projections 712 of the coupling member 71. The first recesses 621 are to be coupled to the first projections 712 and are located at positions facing each other at 180°. Referring to FIGS. 6A to 6C, the drive gear 59 has at least one second recess 591 that has a shape similar to the second projection 714 of the coupling member 71 and is to be coupled to the second projection 714. In this exemplary embodiment, in order to achieve commonality of components and to reduce the number of components, identical gears are used for the drive gear 59 and the transmission gear 62, and the drive gear 59 is provided with two second recesses 591.

Furthermore, because the first projections 712 have the protrusions 713 disposed at asymmetrical positions with respect to the center line of the drive shaft 60, the coupling member 71 and the transmission gear 62 are coupled to each other only at one location in the circumferential direction, so that the phases (positions in the circumferential direction) of the coupling member 71 and the transmission gear 62 are matched. Moreover, similar to the first projections 712, the second projection 714 also has a protrusion 713. Therefore, the coupling member 71 and the drive gear 59 are coupled to each other only at one location in the circumferential direction, so that the phases (positions in the circumferential direction) of the coupling member 71 and the drive gear 59 are matched. As a result, in a state where the drive gear 59 is linked with the transmission gear 62 via the coupling member 71, the phases of the drive gear 59 and the transmission gear 62 are constantly matched.

Furthermore, as shown in FIGS. 6A to 6C, a second coil spring 74 that presses the coupling member 71 away from the drive gear 59 is disposed between the drive gear 59 and the coupling member 71. The movement range of the coupling member 71 is restricted by a pin 76 that is fitted in a second elongated hole 75 extending in the axial direction of the drive shaft 60.

Referring to FIG. 7C, the link member 72 is ring-shaped, and the outer periphery of the ring section thereof is provided with a lever 721 that protrudes radially outward. Furthermore, the outer peripheral surface of the link member 72 is provided with protrusions 723 that have inclined surfaces 722 and that are located at positions facing each other at 180°.

Referring to FIG. 7B, the cover member 73 has a shape of a cylinder that covers the outer periphery of the link member 72. The inner peripheral surface of the cover member 73 is provided with inclined surfaces 731 that come into contact with the protrusions 723 of the link member 72. Furthermore, the cover member 73 is provided with an opening 732 extending at a predetermined angle for allowing the lever 721 of the link member 72 to protrude outward. The cover member 73 is fixedly attached to the housing (not shown) of the driving device 50.

Therefore, the link member 72 is rotated in one direction via the lever 721 so that the inclined surfaces 722 of the protrusions 723 come into contact with the inclined surfaces 731 of the cover member 73, whereby the link member 72 is pressed and moved in the axial direction. Due to this movement of the link member 72, the coupling member 71 is pressed and moved toward the transmission gear 62 in the axial direction by the link member 72 so that the second projection 714 of the coupling member 71 becomes uncoupled from the second recesses 591 of the drive gear 59, as shown in FIG. 6C, whereby the transmission of rotational driving force from the drive gear 59 toward the transmission gear 62 becomes cut off. Furthermore, by rotating the lever 721 of the link member 72 in the reverse direction, the coupling member 71 is pressed and moved toward the drive gear 59 in the axial direction by the link member 72 so that the second projection 714 of the coupling member 71 becomes coupled to the second recesses 591 of the drive gear 59, whereby a rotational driving force is transmitted from the drive gear 59 to the transmission gear 62.

Referring to FIG. 5, the transmission gear 62 attached to the drive shaft 60 of the black photoconductor drum 11 is meshed with the drive gears 59 (59C, 59M, and 59Y) of the cyan, magenta, and yellow photoconductor drums 11 via intermediate gears 77. The drive gears 59 (59K, 59C, 59M, and 59Y), the transmission gear 62, and the intermediate gears 77 constitute a driving-force transmission section of the second driving unit 56.

On the other hand, referring to FIG. 5, the first driving unit 55 includes a transmission gear 79 and a drive gear 80 that receive a rotational driving force from an output gear 78 provided on a drive shaft of the first driving motor 52 and that transmit the driving force to the black (K) developing device 14K. Then, the black (K) developing device 14K is rotationally driven by the drive gear 80.

The transmission gear 79 is linked with a developing-device coupling mechanism 82 as a driving-force transmission mechanism that transmits a rotational driving force to the color developing devices 14 via driven gears 81. The developing-device coupling mechanism 82 basically has a configuration similar to that of the photoconductor coupling mechanism 63.

Figure 9:
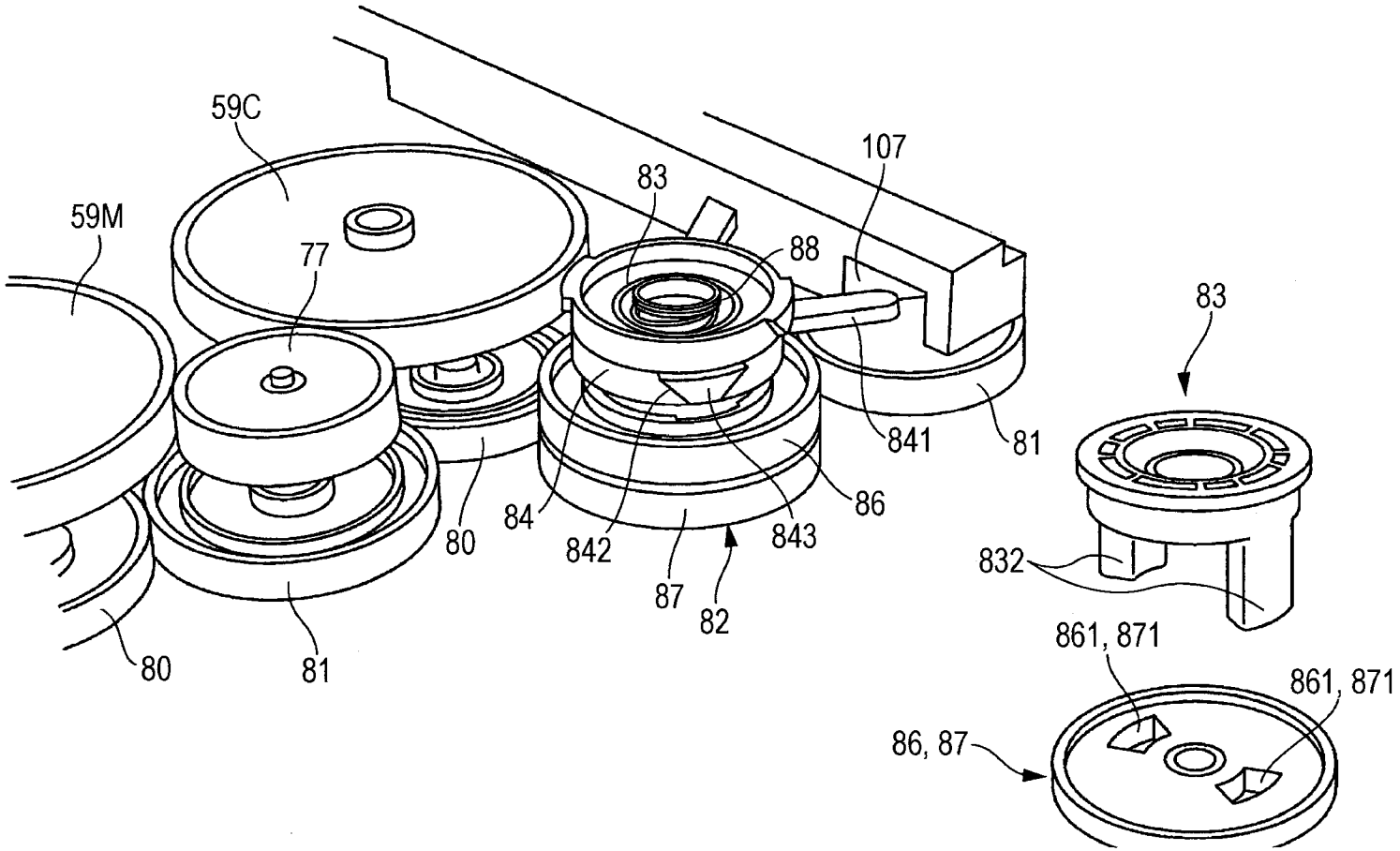
FIG. 9 is a perspective view illustrating the configuration of a driving-force transmission mechanism of a developing device.

Referring to FIG. 9, the developing-device coupling mechanism 82 roughly includes a coupling member 83, a link member 84, and a cover member 85 (see FIG. 8). The coupling member 83 substantially has a shape of a disk with an attachment hole for attaching the coupling member 83 to a rotation shaft (not shown). The developing-device coupling mechanism 82 differs from the photoconductor coupling mechanism 63 in that a drive gear 86 and a driven gear 87 are disposed at the same side in the axial direction of the coupling member 83.

The outer periphery of an end surface of the coupling member 83 adjacent to the drive gear 86 and the driven gear 87 is provided with two projections 832 that protrude parallel to the axial direction and that are located at positions facing each other at 180°. When viewed from the axial direction, each of the projections 832 substantially has a shape of a trapezoid surrounded by a circular-arc-shaped outer peripheral surface, a circular-arc-shaped inner peripheral surface, and opposite end surfaces extending in the radial direction. However, unlike the photoconductor coupling mechanism 63, the projections 832 are not provided with protrusions.

The drive gear 86 and the driven gear 87 respectively have recesses 861 and 871 that have a shape similar to the projections 832 of the coupling member 83. The recesses 861 and 871 are to be coupled to the projections 832 and are located at positions facing each other at 180°. In this exemplary embodiment, in order to achieve commonality of components and to reduce the number of components, identical gears are used for the drive gear 86 and the driven gear 87.

A fourth coil spring 88 is disposed between the inner surface of the cover member 85 and the coupling member 83 and presses the coupling member 83 in a direction for coupling the drive gear 86 and the driven gear 87 (downward in FIG. 9) to each other.

The link member 84 is similar to that shown in FIG. 7C in being ring-shaped, and the outer periphery of the ring section thereof is provided with a lever 841 that protrudes radially outward. Furthermore, the outer peripheral surface of the link member 84 is provided with protrusions 843 that have inclined surfaces 842 and that are located at positions facing each other at 180°.

Referring to FIG. 8, the cover member 85 has a shape of a cylinder that covers the outer periphery of the link member 84. The inner peripheral surface of the cover member 85 is similar to that shown in FIG. 7B in being provided with inclined surfaces (not shown) that come into contact with the protrusions 843 of the link member 84. Furthermore, the cover member 85 is provided with an opening (not shown) extending at a predetermined angle for allowing the lever 841 of the link member 84 to extend therethrough. The cover member 85 is fixedly attached to the housing (not shown) of the driving device 50.

Therefore, the link member 84 is rotated in one direction via the lever 841 so that the inclined surfaces 842 of the protrusions 843 come into contact with the inclined surfaces (not shown) of the cover member 85, whereby the link member 84 is pressed and moved in the axial direction. Due to this movement of the link member 84, the coupling member 83 is pressed and moved toward the drive gear 86 and the driven gear 87 in the axial direction by the link member 84 so that the projections 832 of the coupling member 83 become coupled to the recesses 861 and 871 of the drive gear 86 and the driven gear 87, whereby a rotational driving force is transmitted from the drive gear 86 to the driven gear 87.

Furthermore, by rotating the lever 841 of the link member 84 in the reverse direction, the inclined surfaces 842 of the protrusions 843 come into contact with the inclined surfaces (not shown) of the cover member 85, whereby the link member 84 is pressed and moved in the axial direction. Due to this movement of the link member 84, the coupling member 83 moves in the axial direction to move away from the drive gear 86 and the driven gear 87, so that the projections 832 of the coupling member 83 become uncoupled from the recesses 871 of the driven gear 87, whereby the transmission of rotational driving force from the drive gear 86 toward the driven gear 87 becomes cut off.

Referring to FIG. 5, input gears of the color developing devices 14 are meshed with drive gears 80. The neighboring drive gears 80 of the color photoconductor drums 11 sequentially receive a driving force via intermediate gears. The drive gears 80, the drive gear 86, the driven gear 87, the input gears of the color developing devices 14, and the intermediate gears constitute a driving-force transmission section of the second driving unit 56.

Figure 10:
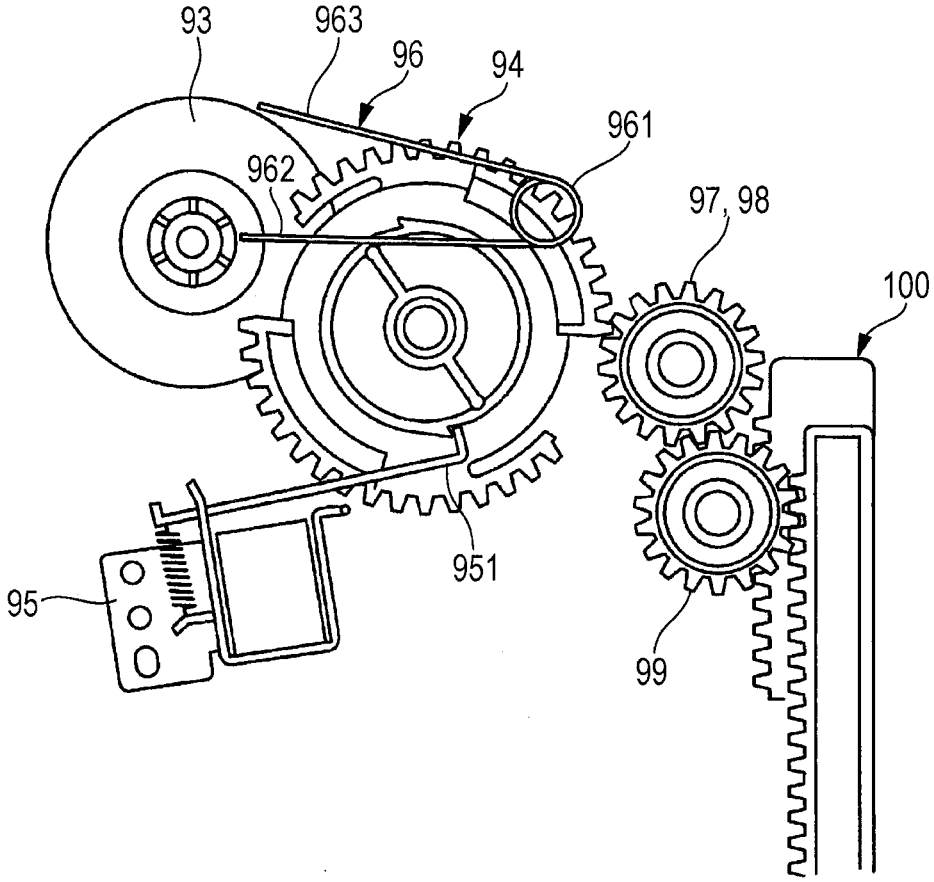
FIG. 10 illustrates the configuration of a drive switching device.
Figure 11A:
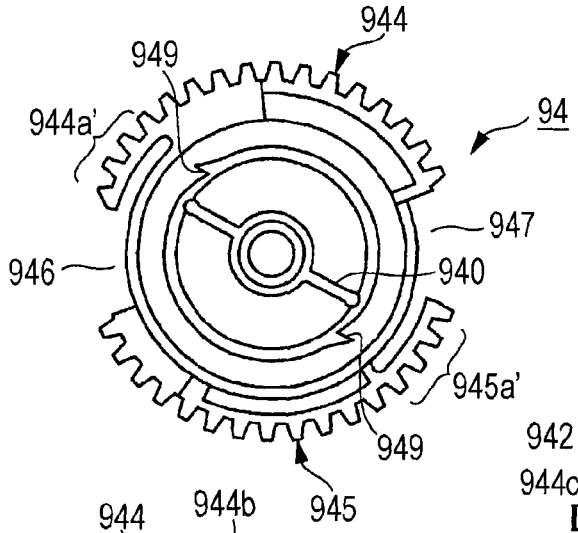
FIGS. 11A to 11D are perspective views illustrating the configuration of a sector gear.
Figure 11B:
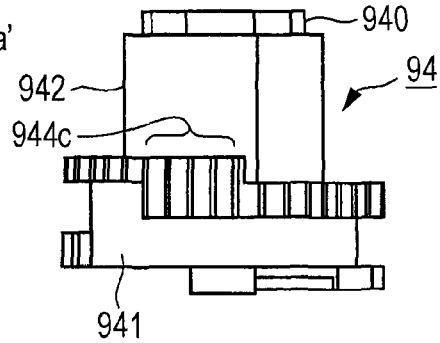
Figure 11C:
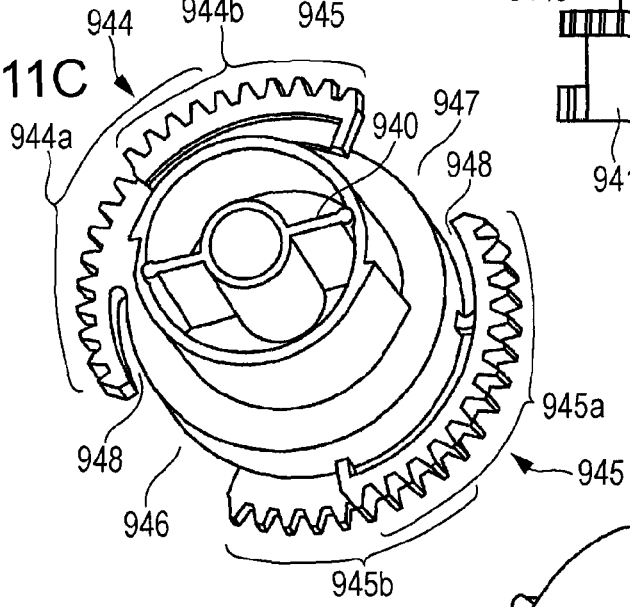
Figure 11D:
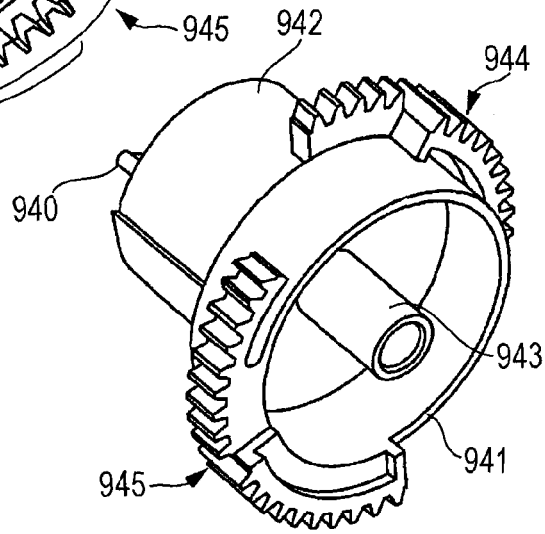

FIG. 10 illustrates the configuration of a drive switching device according to this exemplary embodiment.

A drive switching device uses the third driving motor 54 of the third driving unit 57 as a driving source. The third driving motor 54 is rotationally driven in only one direction. The drive switching device roughly includes a drive gear 93 that receives a rotational driving force from the third driving motor 54, a two-stage sector gear 94 that intermittently meshes with the drive gear 93 and receives a driving force therefrom, a solenoid 95 and a torsion spring 96 for intermittently driving the sector gear 94, a first switch gear 97 that selectively meshes with the sector gear 94 and switches the driving-force transmission direction to a first direction, and second switch gears 98 and 99 that selectively mesh with the sector gear 94 and switch the driving-force transmission direction to a second direction.

Referring to FIGS. 11A to 11D, the sector gear 94 has a hollow cylindrical large-diameter section 941 having a relatively large outside diameter, a hollow cylindrical small-diameter section 942 that is integrated with one axial end of the large-diameter section 941 and that has an outside diameter relatively smaller than that of the large-diameter section 941, and a narrow cylindrical shaft 943 that extends in the axial direction through the center of the large-diameter section 941 and the small-diameter section 942 and that is rotatably supported by a rotation shaft of a housing (not shown).

The sector gear 94 includes a first toothed section 944 and a second toothed section 945 that are provided at different axial and radial positions on the outer periphery of the large-diameter section 941. The first toothed section 944 and the second toothed section 945 are formed symmetrically with respect to the center line of the rotation axis. The first toothed section 944 and the second toothed section 945 extend in the circumferential direction of the large-diameter section 941 and have central angles that are smaller than 180°. Gap sections 946 and 947 where there are no teeth formed on the outer periphery of the large-diameter section 941 are provided between the first toothed section 944 and the second toothed section 945 and are located at positions facing each other at 180°.

Each of the first and second toothed sections 944 and 945 is formed as a two-stage gear with an upstream portion and a downstream portion in the circumferential direction thereof that are disposed at different positions in the axial direction and that are integrated with each other in an intermediate area. More specifically, the first toothed section 944 has an upstream area (upstream portion) 944*a*, in the circumferential direction, disposed toward one axial end thereof and a downstream area (downstream portion) 944*b*, in the circumferential direction, disposed toward the other axial end thereof. The upstream area (upstream portion) 944*a* and the downstream area (downstream portion) 944*b* overlap with each other in an intermediate portion 944*c*. Likewise, the second toothed section 945 has an upstream area (upstream portion) 945*a*, in the circumferential direction, disposed toward one axial end thereof and a downstream area (downstream portion) 945*b*, in the circumferential direction, disposed toward the other axial end thereof. The upstream area (upstream portion) 945*a* and the downstream area (downstream portion) 945*b* overlap with each other in an intermediate portion.

Furthermore, the first and second toothed sections 944 and 945 are provided with notches 948 that extend over a predetermined length at the inner peripheral side of upstream ends 944*a*' and 945*a*' extending in the circumferential direction, such that the upstream ends 944*a*' and 945*a*' are elastically deformable toward the inner periphery. The number of teeth in each of the upstream ends 944*a*' and 945*a*' is set to, for example, about three to five.

As shown in FIGS. 10 and 11A to 11D, the outer peripheral surface of the small-diameter section 942 of the sector gear 94 is provided with securing portions 949 for hooking a hook 951 of the solenoid 95 thereto so as to stop the rotation of the small-diameter section 942. The securing portions 949 are provided at positions facing each other at 180°. Furthermore, the small-diameter section 942 of the sector gear 94 includes a flat-plate-shaped diametrically-extending activation portion 940 that protrudes to the axial end thereof. A first linear portion 962 of the torsion spring 96 is in pressure contact with the activation portion 940 so as to apply an elastic force to the sector gear 94 in the counterclockwise direction. The torsion spring 96 includes a circular portion 961 formed by circularly winding an elastic linear component, and first and second linear portions 962 and 963 extending linearly in tangential directions from the circular portion 961. The circular portion 961 of the torsion spring 96 is disposed in a state where it is positioned within the housing (not shown). The second linear portion 963 is positionally regulated by the housing (not shown) and applies a downward pressing force to the first linear portion 962.

The first switch gear 97 and the second switch gears 98 and 99 that are rotationally driven by a predetermined amount by being intermittently meshed with the sector gear 94 are disposed at the opposite side from the drive side of the sector gear 94. For example, identical gears are used for the first switch gear 97 and the second switch gears 98 and 99. Moreover, the second switch gear 98 is meshed with the second switch gear (reverse gear) 99 that reverses the rotational direction.

Figure 12:
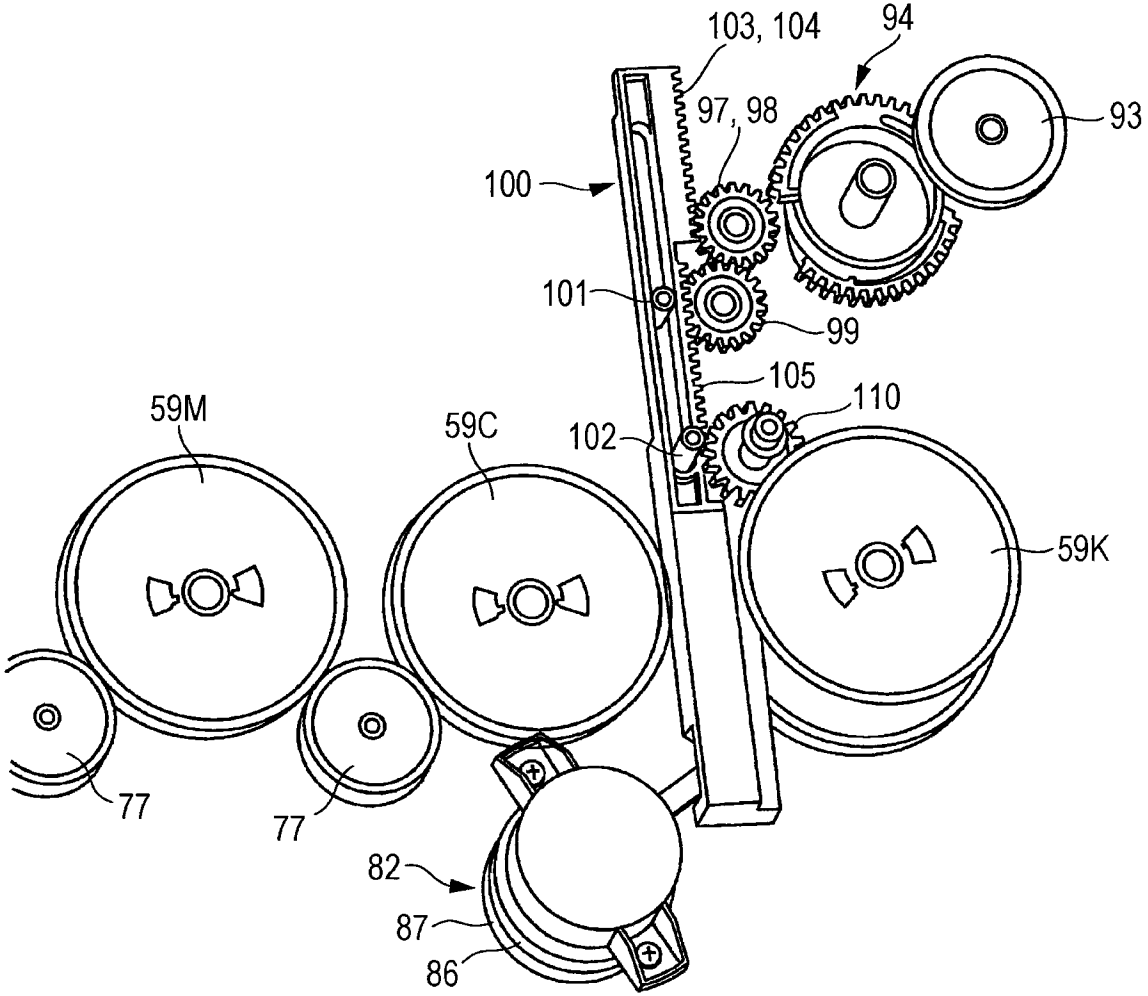
FIG. 12 is a perspective view illustrating the configuration of the driving device.

Furthermore, an actuation plate 100 that operates so as to switch the linked state between the photoconductor coupling mechanism 63 and the developing-device coupling mechanism 82 is disposed at one side of the first and second switch gears 97 and 98. Referring to FIG. 12, the actuation plate 100 has a long and narrow rectangular-rod-like shape and is attached to the housing 51 of the driving device 50 in a vertically movable manner via two rotatable rollers 101 and 102. Moreover, one side surface at an upper end of the actuation plate 100 is provided with first and second rack gears 103 and 104 that are respectively meshed with the first switch gear 97 and the reverse gear 99. Furthermore, one side surface of an intermediate area of the actuation plate 100 is provided with a third rack gear 105 that rotationally drives the eccentric cam 204 (see FIG. 3).

The first and second rack gears 103 and 104 of the actuation plate 100 are formed at predetermined positions and each have a predetermined number of teeth. Likewise, the third rack gear 105 is formed at a predetermined position and has a predetermined number of teeth.

Furthermore, another side surface at an intermediate area of the actuation plate 100 is provided with a first recess that engages with the link member 72 of the photoconductor coupling mechanism 63. Moreover, one side surface of a lower end of the actuation plate 100 is provided with a second recess 107 that engages with the link member 84 of the developing-device coupling mechanism 82.

Furthermore, as shown in FIG. 12, the front surface at the lower end of the actuation plate 100 is provided with a protrusion used by a home-position sensor attached to the housing 51 for detecting a home position of the actuation plate 100.

Operation of Characteristic Part of Image Forming Apparatus

In the image forming apparatus 1 according to this exemplary embodiment, prior to commencing an image forming operation, the controller 5 determines whether the full-color mode or the monochrome mode is selected by the user via a user interface, a print driver, or the like (which are not shown).

Figure 13:
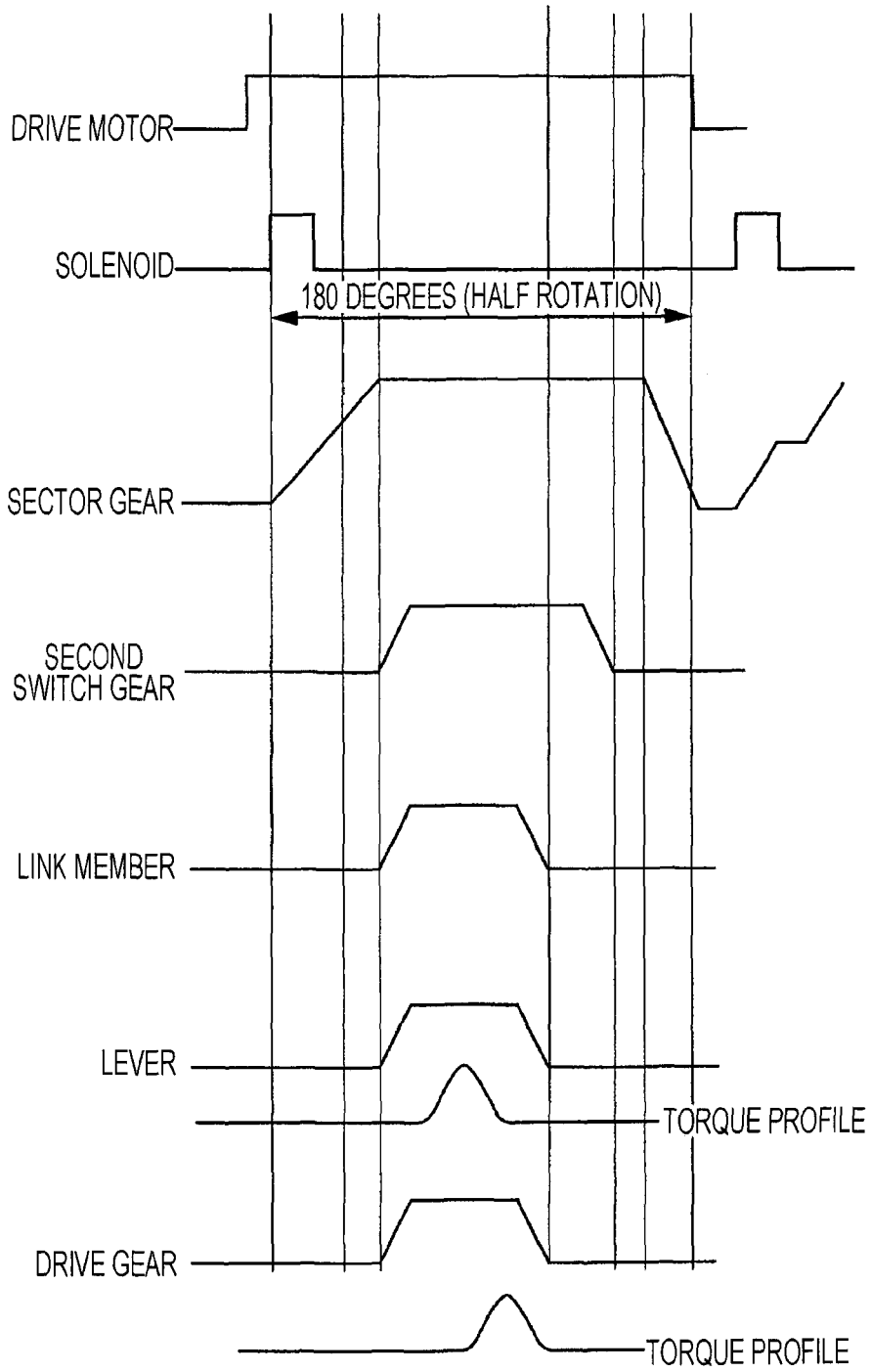
FIG. 13 is a timing chart illustrating the operation of the drive switching device.

Referring to FIG. 13, if the controller 5 determines that the full-color mode has been selected by the user, the controller 5 activates the third driving motor 54 over a predetermined time period and turns on the solenoid 95. Then, referring to FIG. 14, the hook 951 of the solenoid 95 becomes detached from the securing portions 949 of the sector gear 94. This causes the activation portion 940 of the sector gear 94 to be pressed by the elastic force of the first linear portion 962 of the torsion spring 96, whereby the sector gear 94 rotates counterclockwise. After the hook 951 is detached, the solenoid 95 is turned off before the sector gear 94 rotates by 180°.

Figure 14:
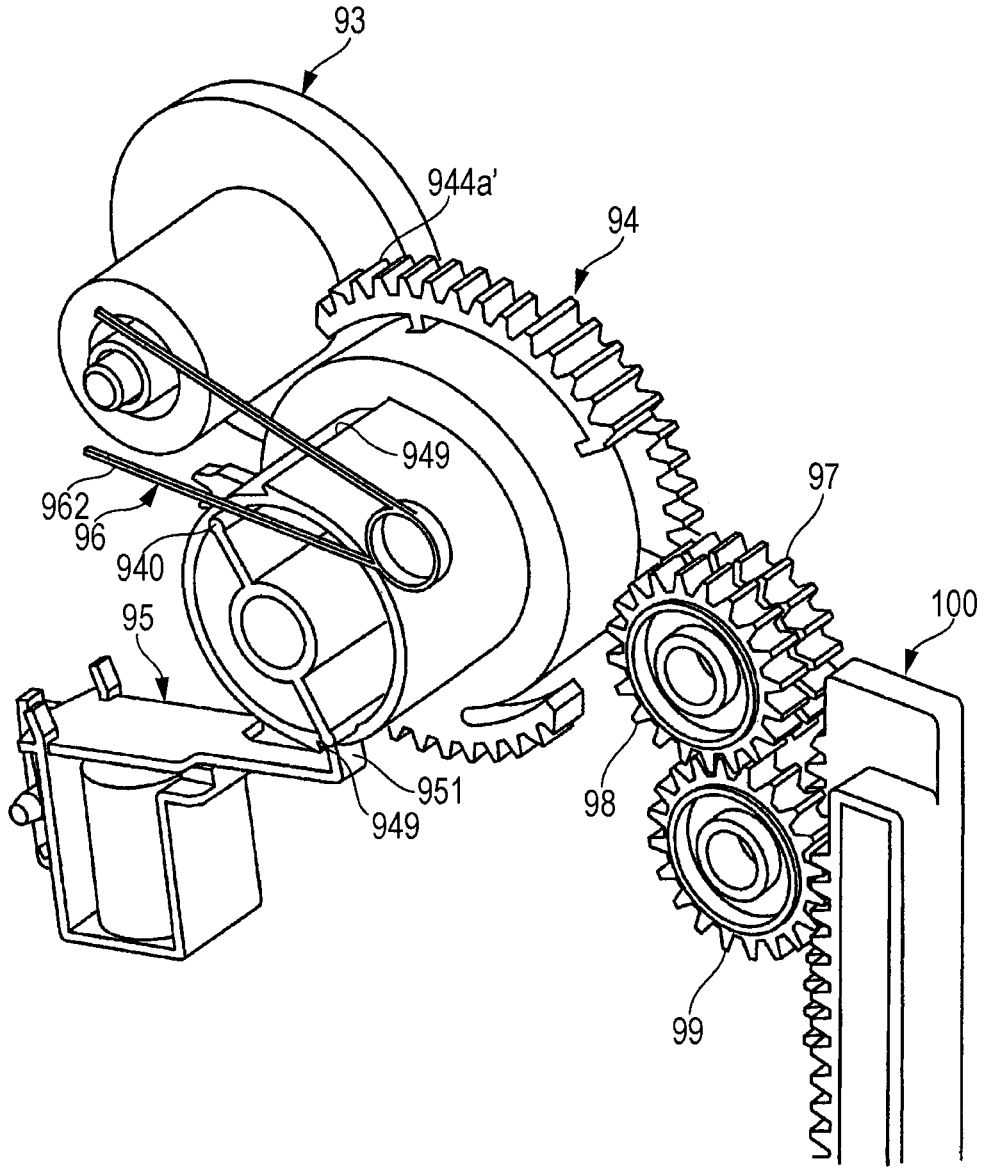
FIG. 14 is a perspective view illustrating the operation of the drive switching device.

When the sector gear 94 rotates counterclockwise, the end 944*a*' of the first toothed section 944 meshes with the drive gear 93 that is rotationally driven by the third driving motor 54. Subsequently, as shown in FIG. 14, the sector gear 94 is rotationally driven in the counterclockwise direction by the drive gear 93. In this case, the first toothed section 944 of the sector gear 94 stably meshes with the drive gear 93 so that the sector gear 94 rotates counterclockwise at a fixed speed due to the rotational driving force transmitted from the drive gear 93.

Figure 15:
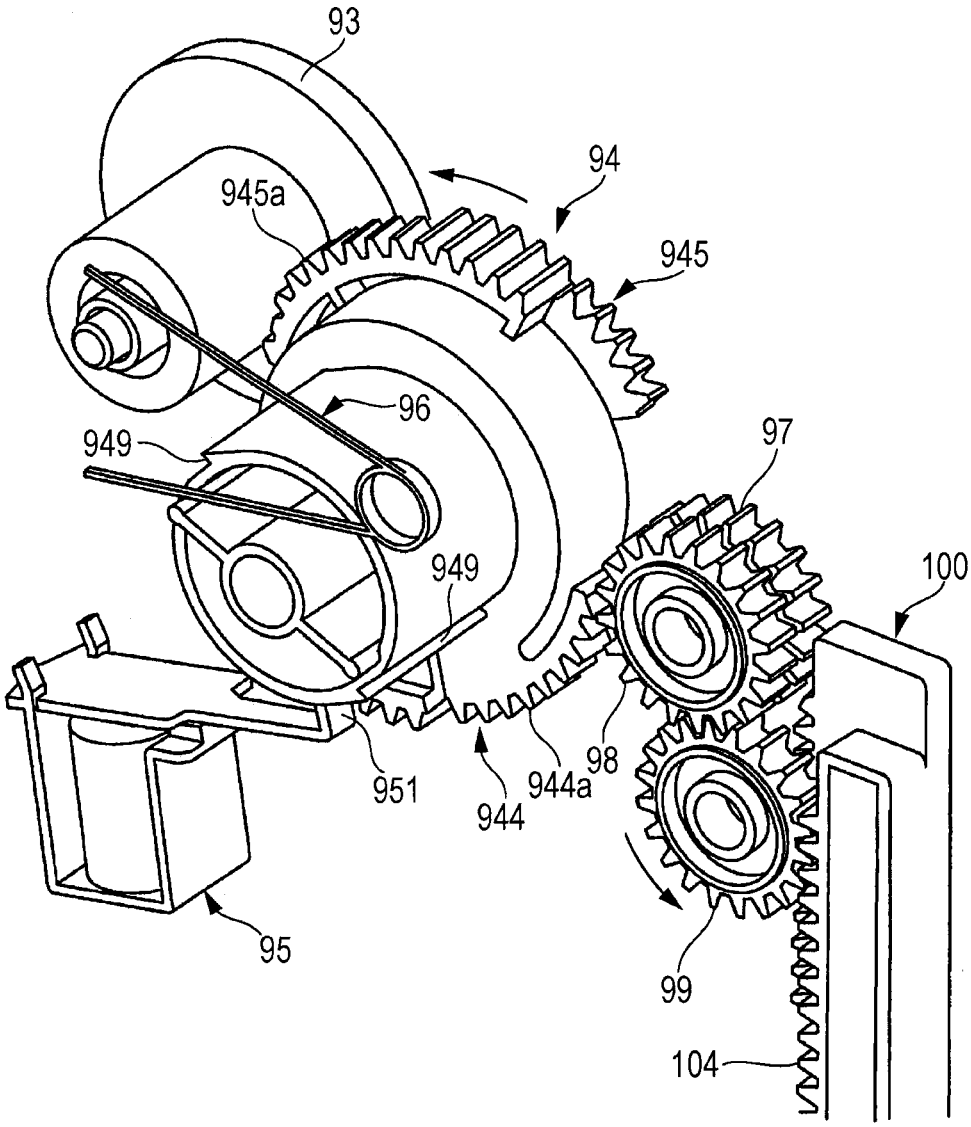
FIG. 15 is a perspective view illustrating the operation of the drive switching device.

Referring to FIG. 15, after the first toothed section 944 of the sector gear 94 stably meshes with the drive gear 93 (about three teeth), the second toothed section 945 meshes with the second switch gear 98 so that the second switch gear 98 is rotationally driven in the clockwise direction. With regard to the rotational driving force of the second switch gear 98, the rotational direction thereof is reversed by the reverse gear 99. Then, the actuation plate 100 is moved upward by the second rack gear 104 meshed with the reverse gear 99.

Due to the upward movement of the actuation plate 100, the link member 72 of the photoconductor coupling mechanism 63 and the link member 84 of the developing-device coupling mechanism 82 that are fitted in the first and second recesses 106 and 107 of the actuation plate 100 rotate. As shown in FIGS. 6A to 6C, with regard to the photoconductor coupling mechanism 63, the lever 721 of the link member 72 is rotated upward so that the coupling member 71 is pressed and moved toward the transmission gear 62, whereby the first projections 712 of the coupling member 71 become coupled to the first recesses 621 of the transmission gear 62. As a result, when the drive gear 59 is driven, the rotational driving force of the drive gear 59 is transmitted to the transmission gear 62. During image forming operation, the transmission gear 62 is rotationally driven so that the drive gears 59 provided on the drive shafts of the color photoconductor drums 11 are rotationally driven via the intermediate gears 77 meshed with the transmission gear 62, whereby the color photoconductor drums 11 are rotationally driven.

On the other hand, as shown in FIG. 9, with regard to the developing-device coupling mechanism 82, the lever 841 of the link member 84 is rotated upward so that the coupling member 83 is pressed and moved toward the drive gear 86 and the driven gear 87, whereby the projections 832 of the coupling member 83 become coupled to the recesses 861 and 871 of the drive gear 86 and the driven gear 87. As a result, the rotational driving force of the drive gear 86 is transmitted to the driven gear 87 so that the driven gear 87 is rotationally driven, whereby the color developing devices 14 are rotationally driven via the drive gear 80 meshed with the driven gear 87, as shown in FIG. 8.

Figure 3B:
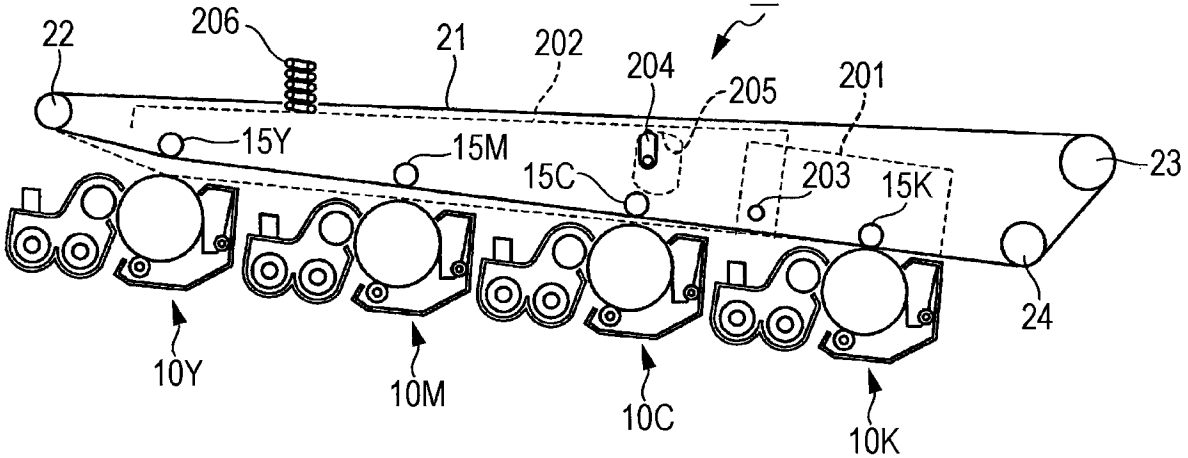

Furthermore, due to the upward movement of the actuation plate 100, a drive gear 110 meshed with the third rack gear 105 of the actuation plate 100 is rotationally driven so that the eccentric cam 204 is rotationally driven in the clockwise direction in FIGS. 3A and 3B. Thus, the first-transfer rollers 15 of the color image forming devices 10 are moved downward, thereby bringing the first-transfer rollers 15 and the intermediate transfer belt 21 into contact with the photoconductor drums 11.

Referring to FIG. 13, the timing at which the actuation plate 100 drives the levers of the link members and the timing at which the eccentric cam 204 is driven by the third rack gear 105 of the actuation plate 100 are offset from each other so that the load on the third driving motor 54 may be reduced.

Figure 16:
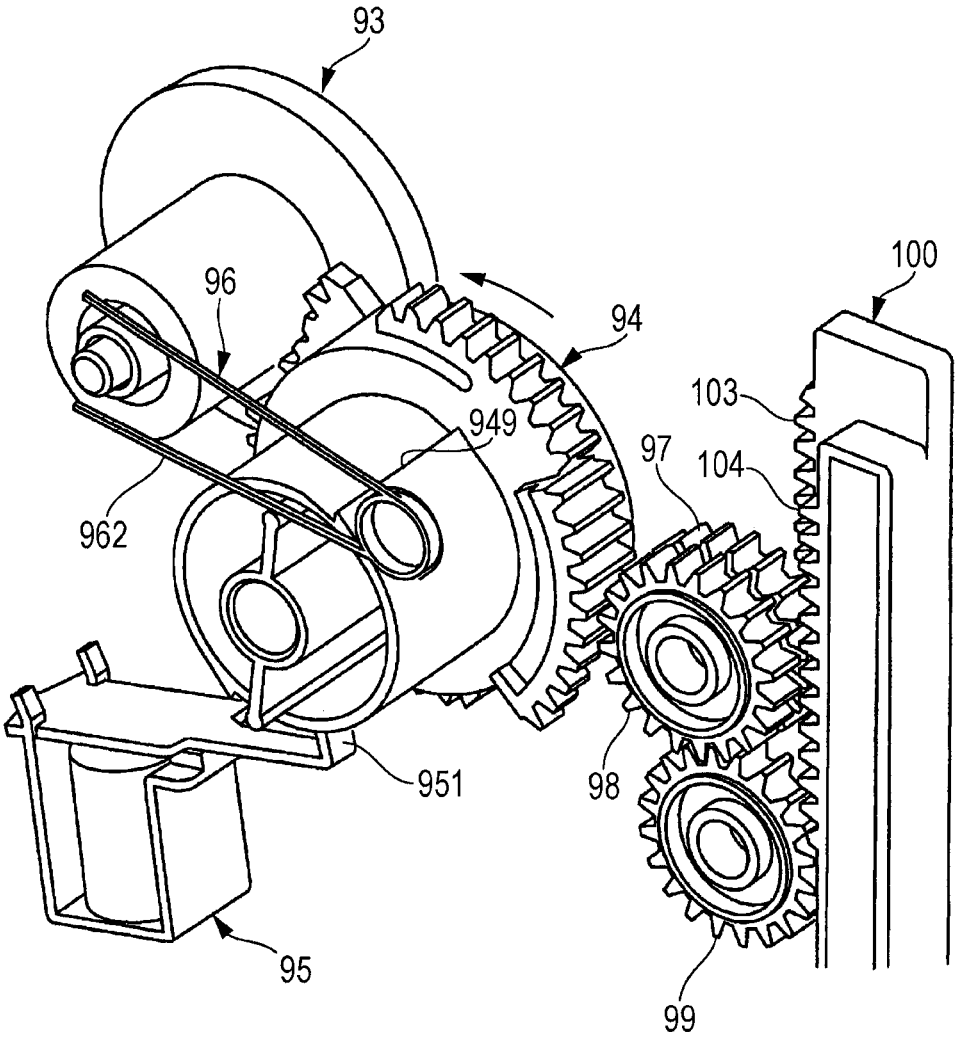
FIG. 16 is a perspective view illustrating the operation of the drive switching device.
Figure 17:
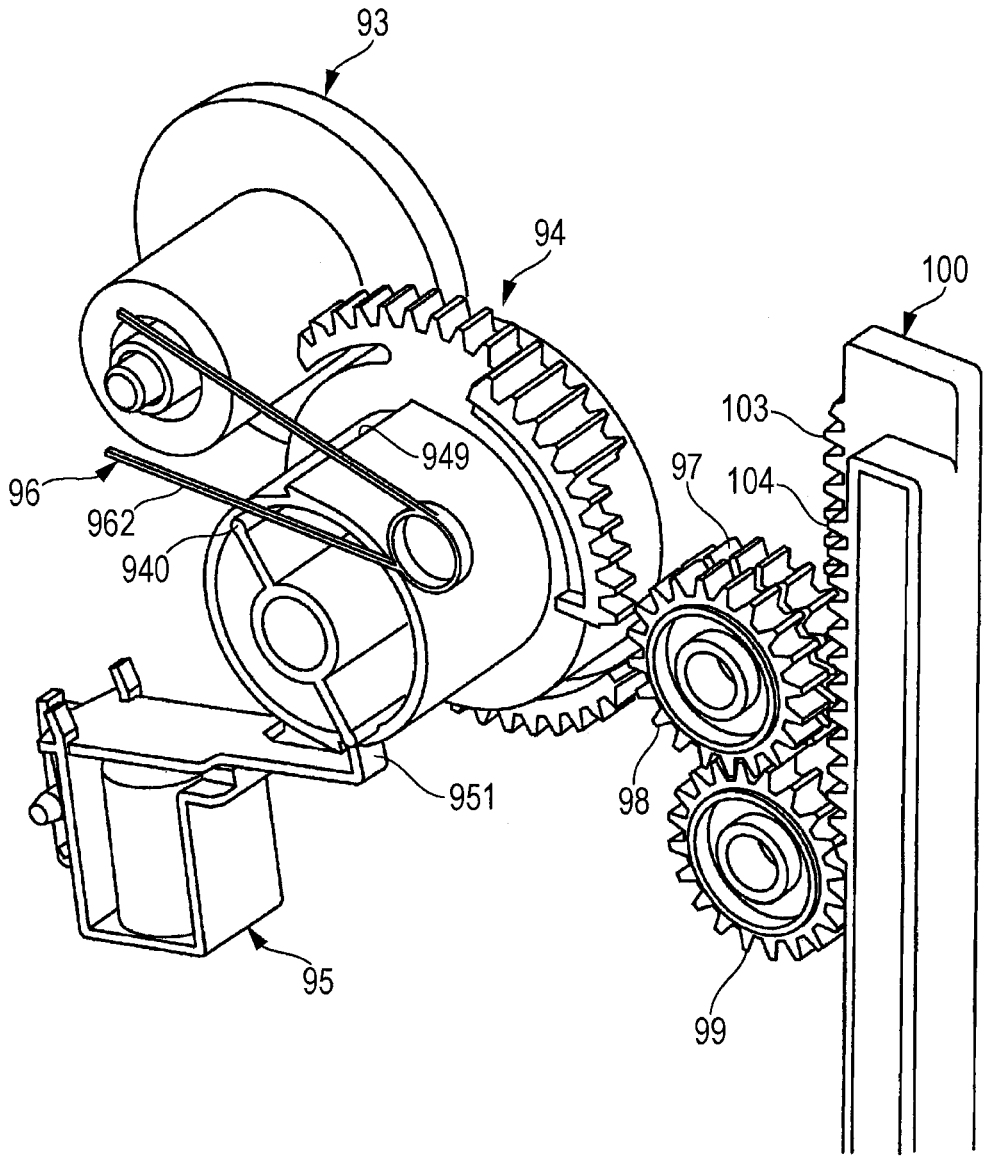
FIG. 17 is a perspective view illustrating the operation of the drive switching device.

Referring to FIG. 16, when the actuation plate 100 is moved upward by a specific amount, the second rack gear 104 becomes detached from the reverse gear 99, causing the actuation plate 100 to stop. Furthermore, after the upstream portion 945*a* of the second toothed section 945 and the second switch gear 98 are completely meshed with each other, the sector gear 94 becomes unmeshed from the second switch gear 98. Subsequently, the first toothed section 944 of the sector gear 94 becomes unmeshed from the drive gear 93. Furthermore, referring to FIG. 17, the sector gear 94 rotates counterclockwise due to the activation portion 940 being pressed by the elastic force of the first linear portion 962 of the torsion spring 96, and the hook 951 of the solenoid 95 becomes secured onto the securing portions 949, causing the sector gear 94 to stop. In this case, referring to FIG. 18, the first switch gear 97 is meshed with the first rack gear 103 of the actuation plate 100.

Subsequently, the controller 5 rotationally drives the first and second driving motors 52 and 53 so as to drive the photoconductor drums 11 and the developing devices 14, thereby commencing full-color-image forming operation.

Referring to FIG. 13, if the controller 5 determines that the monochrome mode has been selected by the user, the controller 5 activates the third driving motor 54 and turns on the solenoid 95. Then, the hook 951 of the solenoid 95 becomes detached from the securing portions 949 of the sector gear 94. This causes the activation portion 940 of the sector gear 94 to be pressed by the elastic force of the first linear portion 962 of the torsion spring 96, whereby the sector gear 94 is rotationally driven (activated) in the counterclockwise direction.

When the sector gear 94 is rotationally driven in the counterclockwise direction, the end 945*a*' of the second toothed section 945 meshes with the drive gear 93 rotationally driven by the third driving motor 54.

Figure 18:
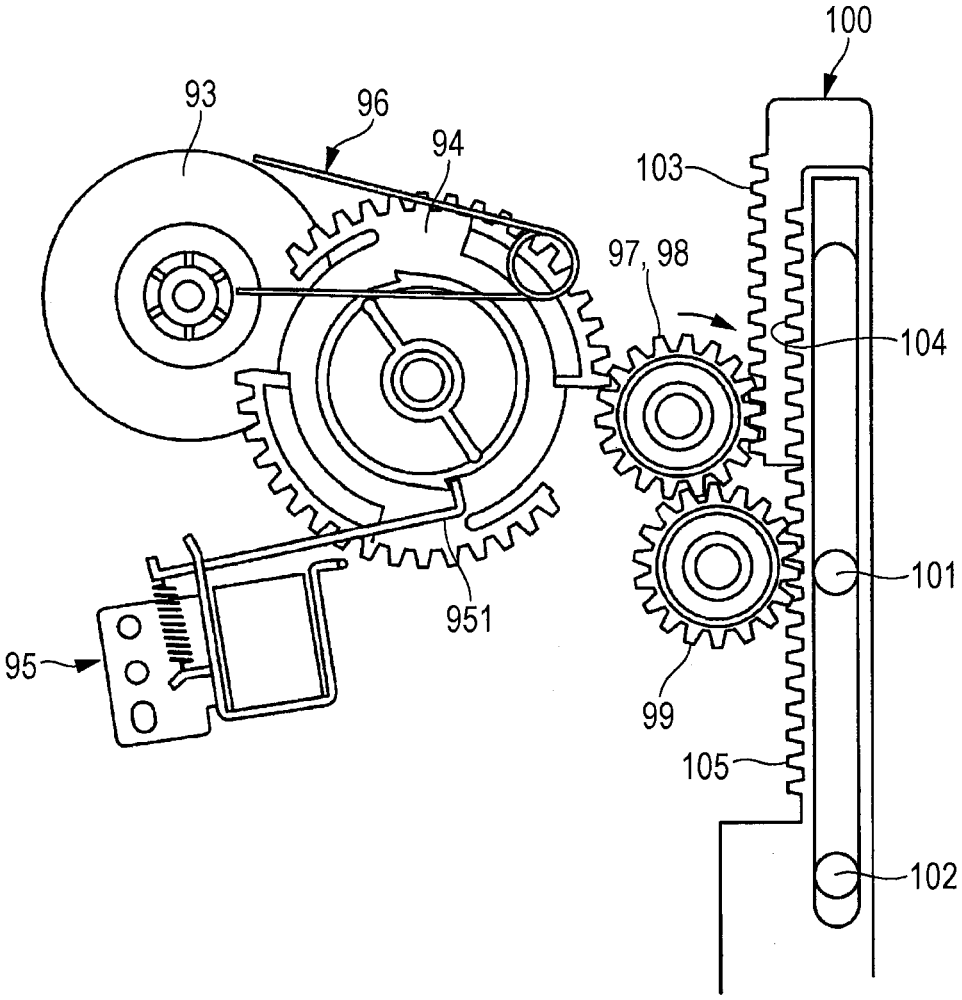
FIG. 18 is a perspective view illustrating the operation of the drive switching device.

Referring to FIG. 18, after the second toothed section 945 of the sector gear 94 stably meshes with the drive gear (about three teeth), the first toothed section 944 meshes with the first switch gear 97 so that the first switch gear 97 is rotationally driven in the clockwise direction. The rotational driving force of the first switch gear 97 is transmitted to the first rack gear 103 of the actuation plate 100, thus causing the actuation plate 100 to move downward.

Due to the downward movement of the actuation plate 100, the link member 72 of the photoconductor coupling mechanism 63 and the link member 84 of the developing-device coupling mechanism 82 that are fitted in the first and second recesses 106 and 107 of the actuation plate 100 rotate. As shown in FIGS. 6A to 6C, with regard to the photoconductor coupling mechanism 63, the lever 721 of the link member 72 is rotated downward so that the coupling member 71 is pressed and moved toward the drive gear 59, whereby the first projections 712 of the coupling member 71 become coupled to the first recesses 621 of the transmission gear 62. As a result, when the drive gear 59 is driven, the rotational driving force of the drive gear 59 is not transmitted to the transmission gear 62, and only the black photoconductor drum 11 is rotationally driven.

On the other hand, as shown in FIG. 9, with regard to the developing-device coupling mechanism 82, the lever 841 of the link member 84 is rotated downward so that the coupling member 83 moves away from the drive gear 86 and the driven gear 87, whereby the projections 832 of the coupling member 83 become detached from the recesses 871 of the driven gear 87. As a result, the rotational driving force of the drive gear 86 is not transmitted to the driven gear 87, and only the black developing device 14 is rotationally driven.

Furthermore, due to the downward movement of the actuation plate 100, the drive gear 110 meshed with the third rack gear 105 of the actuation plate 100 is rotationally driven so that the eccentric cam 204 is rotationally driven in the counterclockwise direction in FIGS. 3A and 3B. Thus, the first-transfer rollers 15 of the color image forming devices 10 are moved upward, thereby moving the first-transfer rollers 15 and the intermediate transfer belt 21 away from the photoconductor drums 11.

Referring to FIG. 10, when the actuation plate 100 is moved upward by a specific amount, the first rack gear 103 becomes detached from the first switch gear 97, and the actuation plate 100 stops in a state where the second rack gear 104 is meshed with the second switch gear 98.

Subsequently, the controller 5 rotationally drives the first and second driving motors 52 and 53 so as to drive the black photoconductor drum 11 and the black developing device 14, thereby commencing monochrome-image forming operation.

Accordingly, in the drive switching device according to this exemplary embodiment, the mode may be switched between the full-color mode and the monochrome mode by simply rotationally driving the third driving motor 54 in one direction. Thus, by reversing the rotational direction of the third driving motor 54, the image forming operation may be immediately commenced, as compared with a case where the actuation plate 100 is moved vertically, whereby a decrease in productivity may be suppressed. Moreover, the third driving motor 54 for driving the fixing device 30 may be directly used as a driving source for driving the drive switching device, so that the number of driving sources may be reduced, thereby allowing for cost reduction.

Furthermore, in the above exemplary embodiment, a single driving motor for rotationally driving the four photoconductor drums 11 may be shared therebetween, and a single driving motor for rotationally driving the four developing devices 14 may be shared therebetween, so that the number of driving sources may be reduced, thereby allowing for cost reduction.

In the above exemplary embodiment, the drive switching device is used for switching between the full-color mode and the monochrome mode. Alternatively, any type of device may be used so long as the device is capable of switching a driving force of a unidirectionally-rotating driving source between a first direction and a second direction.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A drive switching device comprising:

a driving source that is rotationally driven in one direction; and a switching unit that is linked with the driving source such that a driving force therefrom is intermittently transmittable to the switching unit, and that switches a transmission direction of the driving force from the driving source between a first direction and a second direction every time the switching unit is linked with the driving source.

2. The drive switching device according to claim 1, wherein the switching unit includes a sector gear that has a first toothed section and a second toothed section provided at different positions in an axial direction and a circumferential direction, a link unit that intermittently links the sector gear with the driving source, a first transmission unit that transmits a rotational force of the sector gear in a first direction, and a second transmission unit that transmits the rotational force of the sector gear in a second direction.

3. The drive switching device according to claim 2, wherein the link unit includes a stopping unit that stops a gap section located between the first toothed section and the second toothed section of the sector gear at a position facing the driving source, and an activating unit that applies a rotational force in a direction for linking the sector gear with the driving source.

4. An image forming apparatus comprising:

a plurality of image bearing members; and an image-bearing-member driving-force transmission mechanism that is switchable between a first mode and a second mode, the first mode being a mode in which a rotational driving force is transmitted to the plurality of image bearing members, the second mode being a mode in which the rotational driving force is transmitted to at least one of the plurality of image bearing members, wherein the driving-force transmission mechanism is switched to the first mode or the second mode by moving a part of the driving-force transmission mechanism in a first direction or a second direction, and wherein the drive switching device according to claim 1 is used as a drive switching unit that switches a transmission direction of a driving force from a driving source so as to move the part of the driving-force transmission mechanism in the first direction or the second direction.

5. An image forming apparatus comprising:

a plurality of developing units; and a developing-unit driving-force transmission mechanism that is switchable between a first mode and a second mode, the first mode being a mode in which a rotational driving force is transmitted to the plurality of developing units, the second mode being a mode in which the rotational driving force is transmitted to at least one of the plurality of developing units, wherein the driving-force transmission mechanism is switched to the first mode or the second mode by moving a part of the driving-force transmission mechanism in a first direction or a second direction, and wherein the drive switching device according to claim 1 is used as a drive switching unit that switches a transmission direction of a driving force from a driving source so as to move the part of the driving-force transmission mechanism in the first direction or the second direction.

6. An image forming apparatus comprising:

a plurality of image bearing members;

an endless belt member; and a contact-separation mechanism that is switchable between a first contact state in which the belt member is brought into contact with the plurality of image bearing members and a second contact state in which the belt member is brought into contact with at least one of the plurality of image bearing members, wherein the contact-separation mechanism is switched to the first contact state or the second contact state by moving a part of the contact-separation mechanism in a first direction or a second direction, and wherein the drive switching device according to claim 1 is used as a drive switching unit that switches a transmission direction of a driving force from a driving source so as to move the part of the contact-separation mechanism in the first direction or the second direction.

* * * * *